US007922173B2

(12) United States Patent
Stapfer

(10) Patent No.: US 7,922,173 B2
(45) Date of Patent: Apr. 12, 2011

(54) APPARATUS FOR HANDLING DOCUMENTS OF VALUE

(75) Inventor: Michael Stapfer, Neubiberg (DE)

(73) Assignee: Giesecke & Devrient GmbH, München (DE)

( * ) Notice: Subject to any disclaimer, the term of this patent is extended or adjusted under 35 U.S.C. 154(b) by 250 days.

(21) Appl. No.: 12/149,481

(22) Filed: May 2, 2008

(65) Prior Publication Data

US 2009/0051102 A1 Feb. 26, 2009

Related U.S. Application Data

(60) Provisional application No. 60/924,599, filed on May 22, 2007.

(30) Foreign Application Priority Data

May 3, 2007 (DE) ..... 10 2007 020 778

(51) Int. Cl.
*B65H 5/02* (2006.01)
*B65H 39/10* (2006.01)

(52) U.S. Cl. ..... 271/272; 271/296; 271/300; 271/302

(58) Field of Classification Search ..... 271/272, 271/296, 300, 302, 69, 314
See application file for complete search history.

(56) References Cited

U.S. PATENT DOCUMENTS 4,106,767 A 8/1978 Schirrmeister
5,660,383 A * 8/1997 Ueffinger et al. ..... 271/3.18
6,012,715 A 1/2000 Kasahara
7,311,303 B2 * 12/2007 Gonzalez et al. ..... 271/296
2002/0101023 A1 8/2002 Saltsov et al.
(Continued)

FOREIGN PATENT DOCUMENTS

DE 26 55 580 6/1977
(Continued)

OTHER PUBLICATIONS

Search Report of German Patent Office in German Patent Application No. 10 2007 020 778 8, Apr. 24, 2008, 4 pgs.
(Continued)

*Primary Examiner* — David H Bollinger
(74) *Attorney, Agent, or Firm* — Bacon & Thomas, PLLC

(57) ABSTRACT

An apparatus for handling documents of value comprises at least a first device, which has a transport path portion, along which a document of value is transported to and/or from the first device and/or into the first device, at least a second device, which has a transport path portion, along which a document of value is transported to and/or from the second device and/or into the second device, wherein the devices are arranged such that a document of value can be transported from the transport path portion of the first device into the one of the second device and/or from the transport path portion of the second device into the one of the first device, and at one coupling end of the respective transport path portion in a fixed position in relation to the respective transport path portion a pair of rolls mounted to be rotatable around a rotation axis, between the rolls of which a document of value is clamped when transported and the rolls of which in a section through the rotation axis have a comblike structure, the pairs of rolls being arranged and formed such that the rolls of a first of the pairs of rolls and the respective rolls of a second of the pairs of rolls in the coupling position intermesh in a combing fashion.

46 Claims, 15 Drawing Sheets

U.S. PATENT DOCUMENTS

Figure 1:
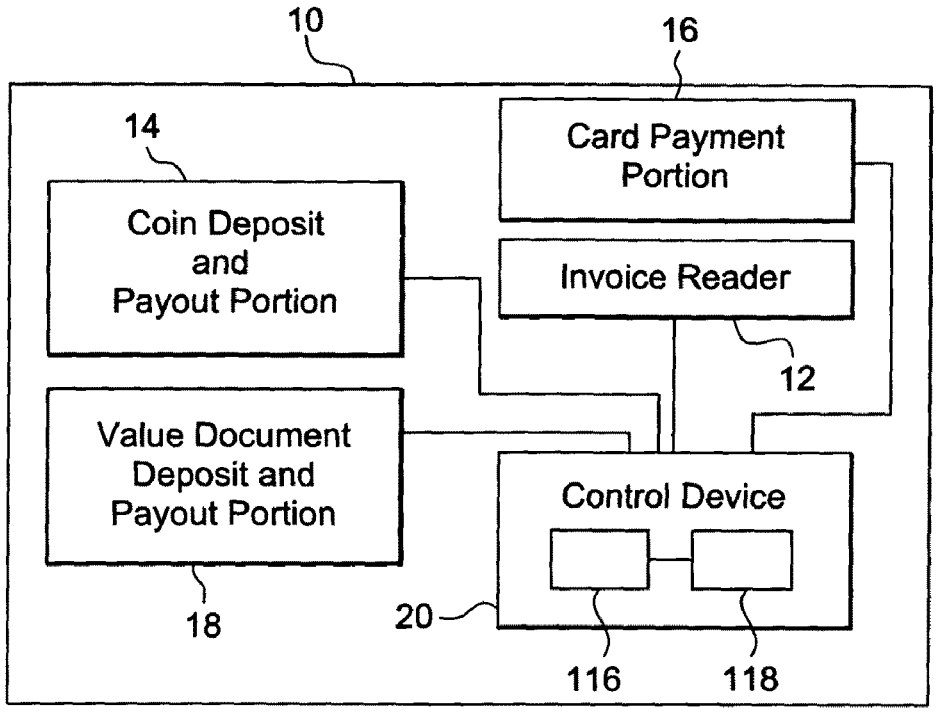

2007/0194522 A1* 8/2007 Cheng et al. ..... 271/272

FOREIGN PATENT DOCUMENTS

| | | | |
|---|---|---|---|
| DE | 697 22 365 | T2 | 4/2004 |
| EP | 0 854 453 | B1 | 7/1998 |
| EP | 1 296 291 | A2 | 3/2003 |
| EP | 1 433 728 | A1 | 6/2004 |
| WO | WO 2004/081884 | A2 | 9/2004 |

OTHER PUBLICATIONS

International Search Report of International Application No. PCT/EP2008/003558, Sep. 12, 2008.

* cited by examiner

APPARATUS FOR HANDLING DOCUMENTS OF VALUE

The present invention relates to an apparatus for handling documents of value.

In this context, documents of value are sheet-shaped objects, which, for example, represent a monetary value or an authorization and thus shall not be producible at will by unauthorized persons. Therefore, they have features not easy to produce, in particular to copy, the presence of which is a sign for the authenticity, i.e. the manufacturing by an authority authorized thereto. Important examples of such documents of value are chip cards, coupons, vouchers, checks and in particular bank notes. A peculiarity of such documents of value, in particular of bank notes, compared to new paper or writing paper is that their state can strongly vary for example caused by creases, folds, dog ears or a considerable limpness.

Apparatus for handling documents of value in the context of the invention in particular means apparatuses for transporting and/or for storing documents of value. Because of the peculiarity of documents of value, in particular bank notes, their transport by machine in such apparatuses for handling documents of value is prone to trouble. Though documents of value can be transported in singled form with a not very high trouble-proneness by means of belt transport systems, such systems are not very suitable for the transport over short distances.

Therefore, the present invention is based on the problem to provide an apparatus for handling documents of value, which permits a transport of documents of value not very prone to trouble with a simple structure.

According to a first alternative the problem is solved by an apparatus for handling documents of value having at least a first device, which has a transport path portion, along which a document of value is transported to and/or from the first device and/or into the first device, at least a second device, which has a transport path portion, along which a document of value is transported to and/or from the second device and/or into the second device, the devices being arranged such that a document of value can be transported from the transport path portion of the first device into the one of the second device and/or from the transport path portion of the second device into the one of the first device, and at a coupling end of the respective transport path portion in a fixed position in relation to the respective transport path portion a pair of rolls mounted to be rotatable around a rotation axis, between the rolls of which a document of value is guided (clamped) when transported and the rolls of which in a section through the rotation axis have a comblike structure, the pairs of rolls being arranged and formed such that the rolls of a first of the pairs of rolls and the respective rolls of a second of the pairs of rolls in the coupling position intermesh in a combing fashion.

A transport path portion here and in the following means every, possibly very short, distance along which a document of value is transported. The devices can be, for example, storages for documents of value or other transport devices. In the case of storage devices the transport path portions can be those portions, along which a document of value is transported into the actual storage space of the storage.

Using the pairs of rolls has two advantages at the same time: Each of the pairs of rolls on its own clamps a document of value for transporting and already that reduces the trouble-proneness. By the mesh of rolls corresponding to each other of the pairs of rolls at the same time a gap is avoided which extends transversely to the transport path or a very deep indentation is avoided which extends transversely to the transport path, so that the leading edges of documents of value, when viewed in the transport direction, cannot be easily creased, even when the documents of value are limp. Thus the result is a very reliable transport.

Furthermore, the apparatus requires only very little structural space.

According to a second alternative the problem is solved by an apparatus for handling documents of value having at least a first device, which has a transport path portion, along which a document of value is transported to and/or from the first device and/or into the first device, at least a second device, which has a transport path portion, along which a document of value is transported to and/or from the second device and/or into the second device, a moving device, by means of which the second transport path portion is movable relative to the first transport path portion along a predetermined curve, so that in at least one relative coupling position of the devices a document of value can be transported from the transport path portion of the first device into the one of the second device and/or from the transport path portion of the second device into the one of the first device, and at a coupling end of each respective transport path portion in a fixed position in relation to the respective transport path portion a pair of rolls mounted to be rotatable around a rotation axis, between the rolls of which a document of value is clamped when transported and the rolls of which in a section through the rotation axis have a comblike structure, the pairs of rolls being arranged and formed such that the rolls of a first of the pairs of rolls and the respective rolls of a second of the pairs of rolls in the coupling position intermesh in a combing fashion and in case of a move into or from the coupling position are guided past each other in a combing fashion.

The second alternative differs from the first alternative in that the two devices are movable relative to each other by means of the moving device, which besides a drive unit in particular can also have a guide for guiding the second device along the predetermined curve, so that the transport path portions, depending on the requirements, have to be coupled only temporarily. A coupling does only take place in the coupling position, in which the devices are suitably positioned and thus also the pairs of rolls held firmly between them relative to the devices for a transport of documents of value.

This alternative besides the advantages of the first alternative offers the great advantage, that transport paths, depending on the requirements, only have to be formed temporarily by a movement of the devices and the pairs of rolls and a movement of the transport path portions connected therewith.

In principle, in the apparatus according to the second alternative the curve portion can extend in any fashion. Position and form of the curve portion can be determined in particular by the moving device, which for this purpose can have a drive unit mechanically coupled with the second device and a guide or guide device, the formation of which determines the movement of the second device and with that the path of the transport portion of the second device or the position and the form or the course of the second curve portion. Preferably, the curve portion extends in a plane, to which in particular the transport directions in the transport path portions can extend in parallel. When the curve portion extends linearly and does not determine a plane, then the plane is spanned by the curve portion and the transport direction in one of the transport path portions. This means in each of the cases, that then the rotation axes, which here and in the following means only a geometrical axis, during any movement are aligned in parallel to each other, when the transport path portions or the transport directions in these portions extend, at least in good approximation, in parallel to the plane.

The apparatus can further have at least one further device, which has a transport path portion, along which a document of value is transported to the and/or from the further device and/or into the further device, and which is disposed in a fixed position relative to the first device along the curve portion, so that in at least one relative coupling position of the devices a document of value can be transported from the transport path portion of the further device into the one of the second device and/or from the transport path portion of the second device into the one of the further device, at a coupling end of the transport path of the further device being disposed in a fixed position in relation to the transport path portion a pair of rolls mounted to be rotatable around a rotation axis, between the rolls of which a document of value is clamped when transported and the rolls of which in a section through the rotation axis have a comblike structure, and the pairs of rolls being disposed and formed at the end of the transport paths of the further device and the second device such that the rolls of the pair of rolls at the end of the transport path portion of the further device and the respective rolls of the pair of rolls at the end of the transport path portions of the second device in the coupling position intermesh in a combing fashion and in case of a movement into the or from the coupling position are guided past each other in a combing fashion. Though said further pair of rolls fulfils the same function as the first pair of rolls and also has the same structure as it, it does not necessarily have the same rolls. In particular, the transport direction in the transport portion of the further device can extend at least approximatively in parallel to a plane, which is determined by the curve portion. Especially preferred the curve portion is linear; then the rotation axes extend in parallel.

In the context of the invention rolls mean any rotatable elements with a circular cross section in a plane orthogonal to the rotation axis, which in a direction parallel to the rotation axis can have any suitable length. For example, they can be rollers, in the roller surface of which is formed a comblike profile, for example by milling or primary forming. But a roll can also be obtained by fastening wheels on a shaft or axle in a suitable distance from each other, which then form the comblike structure. The rolls for the first device and the further device in principle can be formed different. But an especially simple construction is obtained, when the rolls of the pairs of rolls for the first and the further device are equally formed. Furthermore, then the transport properties match.

In principle, the transport paths do not necessarily have to extend orthogonally to the curve portion, when the devices assume the coupling position. An operation with an especially low trouble rate is obtained when in the apparatus in the coupling position lines given by a gap that is formed between the rolls of a respective pair of rolls or by a tangent line along which the rolls of a respective pair of rolls touch each other lie in a plane with the coupling end of at least one of the transport path portions.

The following developments and preferred embodiments are suitable for apparatuses of both alternatives.

In principle, none of the rolls of the pairs of rolls has to be driven. But to permit an active transport, for at least one roll of one of the pairs of rolls the apparatus can have a drive unit for rotating the roll. Since the document of value is clamped when passing the pairs of rolls, it can be transported actively.

As a drive unit can be used, for example, a motor directly or indirectly mechanically coupled with the driven roll. If, however, an exact adjustment of the position of the document of value is to be possible, the drive unit preferably comprises a stepper motor.

When only one roll of a pair of rolls is driven, considerable shearing forces can possibly be exerted on the document of value. For this reason in the apparatuses the rotational movements of the rolls of at least one of the pairs of rolls, can be, preferably mechanically, coupled. This has the advantage, that with a suitable coupling considerably lower shearing forces are exerted on the document of value.

In case the two rolls of a pair of rolls are driven, preferably they are rotated in the same direction, if only one of the rolls is driven, preferably the other is not separately slowed down or stopped by a brake device, except for the usual influences caused by the bearing of the roll.

In principle it is possible, that only one of the pairs of rolls has at least one driven roll. But preferably in both pairs of rolls at least one of the rolls is driven. With that an improved transport can be effected. Preferably, the drive units are set up or activated such that the transport speed of the pair of rolls lying in transport direction is greater than the one of the pair of rolls combing with it. With that a tensile force can be exerted on the document of value, which can clearly reduce the probability of malfunctions.

Generally, but in particular also for the last mentioned option, in the apparatuses of both alternatives there can be provided a drive unit for each of the two pairs of rolls for rotating at least one of the rolls of the respective pairs of rolls.

When the apparatus is provided with the further device and the further pair of rolls associated thereto, for each of the pairs of rolls can be provided a separate drive unit. In particular with apparatuses in which the first device and the further device have a similar or analogue function, the apparatus according to the second alternative, however, can have a joint drive unit, which drives at least one of the roll of the pairs of rolls at the coupling end of the transport path portions of the first and the further device. This can distinctly reduce the number of drive units of the apparatus. This reduction can be considerable in particular in case of more than two devices having pairs of rolls, in relation to which the second device is moved.

In principle in the apparatuses according to the two alternatives it is sufficient when the rolls of a pair of rolls can comb with corresponding rolls of the other pair. To keep low a deformation of a document of value between the combing rolls and the risk of malfunction connected therewith, the rolls of the two pairs of rolls preferably intermesh to such an extent, that in case of a combing mesh protruding areas of the rolls of the one pair of rolls are located in a plane extending through the rotation axes of the rolls in a distance of between 0.5 millimeters and 3 millimeters from the axis or the recessed area of the rolls of the second pair of rolls.

Furthermore, it can be favorable, when the outside diameter of the rolls is between 13 millimeters and 15 millimeters. Though the required space slightly increases compared to the use of rolls having a smaller diameter, the risk of malfunctions is reduced which occur when the leading edge of a document of value encounters one of the rolls relatively far apart from the clamping area between the rolls of a pair of rolls.

In principle, as a material for the surface of the rolls there can be chosen any material. In particular, the rolls of a pair of rolls can have different surface materials or an equal surface material. But to achieve an especially good clamping, it is preferred, that at least the protruding surface areas of at least the driven rolls are made of an elastic material. An elastic material is here a material, the ductility or elasticity of which, determined by the modulus of elasticity, is greater by at least a factor 10 than that of pure aluminum.

The rolls of a pair of rolls can have different outside diameters. But preferably the rolls of at least one pair of rolls have the same outside diameter. On the one hand this facilitates the manufacturing and on the other hand also permits better transport properties.

It is also preferred, that the rolls of the pairs of rolls for the first and the second transport path portion have equal outside diameters. By this, too, the risk of transport troubles is reduced, since there are less asymmetries in the transport path.

When in particular an apparatus for accepting and outputting documents of value is to be provided, which has a low trouble-proneness with a simple structure, the apparatus according to the second alternative can in particular be formed to accept, check documents of value as well as to output documents of value, and further comprises: a checking device for checking the authenticity of fed documents of value, a storage unit, which as first and further devices comprises at least two storages for storing at least two different types of documents of value, so that a document of value of each of the two types, independently of the order of input of the documents of value into the storage unit, can selectively be outputted from the storage unit and the pairs of rolls each form storage transport interfaces, as a second device a temporary storage of a temporary storage unit for the singled temporary storage of at least two checked documents of value, which can be displaced between at least one accepting position, in which documents of value transported from the checking device can be temporarily stored in the temporary storage unit, and the storing positions associated to the storages and representing coupling positions, in which at least some of the documents of value temporarily stored in the temporary storage unit can be transported from the temporary storage unit into the respective storage, the respective pair of rolls being part of a temporary storage transport interface, and as a moving device a transport system, by means of which the temporary storage unit is displaceable between the accepting position and the storing positions.

This apparatus is designed to accept and output documents of value of predetermined types. Such, in particular, can be vouchers and bank notes. In particular it can be designed for bank notes of various types, for example predetermined denominations of one or a plurality of currencies. Then the components of the apparatus are adapted such that the apparatus can process the documents of value of the predetermined types.

The temporary storage unit serves to temporarily receive documents of value checked by the checking device. At the time of the receiving process the check of the documents of value does not have to be completed, it is rather sufficient that the checking device has detected at least one property of the document of value, which is used for checking the document of value. The evaluation of the detection result, depending on the design of the checking device, can also be effected during the temporary storage, but preferably is completed during the temporary storage.

The temporary storage unit is displaced between various coupling positions relative to the checking device and the storage unit, in which at least one transport path portion of the temporary storage unit is coupled or can be coupled with at least one corresponding transport path portion of the checking device or the storage unit, so that a transport from the checking device to the temporary storage unit or between the temporary storage unit and the storage unit is possible. The coupling position for accepting documents of value from the checking device is the accepting position, while the coupling positions for the exchange of documents of value with the storage unit are the storing positions.

The use of the temporary storage unit displaceable by means of the transport system allows a very fail-safe transport of the documents of value independent of their state, since once they have reached the temporary storage unit without trouble a substantial part of the transport path can be covered in it. Moreover, in case of a suitable design of the apparatus one can do without diverters for distributing the documents of value among the storages of the storage unit, which further increases the reliability.

In the context of the present invention the term transport interface is generally used for transport interface devices with mechanical elements, i.e. is not to be confused with electric interfaces. I.e. the pairs of rolls form two interfaces complementary to each other. The use of such pairs of rolls permits a transport of documents of value especially immune to trouble.

The storage unit serves to store documents of value and in particular can also be formed to re-output at least one predetermined type of documents of value stored in it, i.e. in particular has at least one recycling storage or input/output storage.

For storing the documents of value the storage unit in principle can have any storages. But since the storage unit as far as possible also should allow a re-output of already accepted documents of value, preferably at least one of the storages of the storage unit is a storage from which documents of value can be outputted in singled fashion.

To minimize the mechanical effort for once more singling the documents of value, at least one of the storages of the storage unit can be a storage in which at least two documents of value are storable in singled fashion. In particular, the storage can be a winding storage. Winding storages have the advantage, that they permit a singled storing of a relatively great number of documents of value in a small space and are not very prone to malfunctions.

Alternatively or additionally, it is possible that at least one of the storages of the storage unit is a storage in which documents of value are storable as stacks. Such storages are characterized by an especially high storage capacity in relation to the structural space. In principle such a storage can be used or formed as an input, output or input/output storage. In the two latter cases, preferably, a singler is provided for the storage. The singler can be firmly connected with the storage or fly connected with the apparatus. The latter option permits the use of very simple stacking storage cassettes which are easy to exchange.

In particular, it is possible that the storage unit at least has one output storage, from which documents of value are only outputted. Depending on the embodiment of the output storage it can be formed such that in normal operation documents of value can only be outputted from it. Such a storage can be advantageous in particular when, typically, bank notes of a certain denomination, for example the smallest denomination of a currency intended for the apparatus, have to be outputted more often than they are accepted. Then a stockpile of these bank notes can be provided, which allows an operation over a prolonged time period, before the apparatus does not contain bank notes of the smallest denomination any longer and possibly has to be turned off.

In principle, the storages and with that the storing position can have any arrangement relative to the accepting position. An especially simple construction, however, will be the result, when the at least one accepting position and the storing positions are located along a linear path. In particular, the transport system can have a linear guiding element, along which the temporary storage unit is displaceably guided on a linear path between the at least one accepting position and the storing positions.

The path, along which the temporary storage unit is displaceable, in principle can have any orientation. But in order to permit an especially small floor space for the apparatus, the linear path preferably encloses an angle smaller than 10° with the vertical, and especially preferably it extends substantially vertically. The term "vertical" here means, that in the case that the entire apparatus is arranged horizontally, the respective direction extends vertically, i.e. in parallel to the falling direction.

In principle, the storages of the storage unit in the apparatus can be fly connected to it, so that they can be removed from the apparatus at most with the help of tools. But preferably there is provided, in particular as a part of the storage unit, a retaining device with at least one retainer for at least one of the two storages, and the storage is designed as a module connectable with the respective retainer and detachable from it. Preferably, the retaining device is provided with retainers for all its storages and all storages of the storage unit are designed as a module connectable the respective retainer and detachable from it. In this way a storage exchange can be effected very easy, which facilitates the maintaining of the apparatus.

A particularly simple exchangeability even for personnel not specifically equipped for maintenance work is obtained in that the retainer and the at least one storage are formed such that the at least one storage is connectable with and detachable from the respective retainer without tools. The storage, for example, can be hung, latched, or engaged into the retainer. The manufacturing of the apparatus will be particularly easy and efficient, when the retainers of the retaining device are equally formed, since then equal storage modules can be used.

In principle, the temporary storage unit can have one or a plurality of any devices for temporary storing documents of value, which in particular allow an input and a re-output of fed documents of value. To permit a singled storage with a simple construction, the temporary storage unit can be provided with a temporary storage for at least two documents of value which can be inputted into the temporary storage or outputted from it only one after the other. The temporary storage in particular can also be a winding storage. Preferably, the temporary storage, in particular also the winding storage, has a storage capacity for more than two documents of value, so that a greater number of documents of value can also be accepted.

In principle, it is sufficient when for the singled temporary storage of at least two checked documents of value the temporary storage unit has one temporary storage. But it is preferred, that the temporary storage unit has at least two temporary storages. This allows a greater variability when temporary storing. For example, one of the temporary storages can serve to temporarily store a document of value, for which the checking device has picked up measuring values, an evaluation with respect to the denomination, validity or authenticity however has yet been effected.

In particular in this case, preferably, at least one of the at least two temporary storages is a temporary storage for a single document of value.

To be able to also transport a greater number of documents of value, in particular when using the described temporary storage for one single document of value, into the storage unit, at least one of the at least two temporary storages can be a temporary storage, in particular a winding storage, for at least two documents of value which can be inputted into the temporary storage or outputted from it only one after the other.

Alternatively or additionally, each of the at least two temporary storages can be a temporary storage for one single document of value, into which or from which a document of value can selectively be inputted or outputted.

To permit a transport with a low trouble rate between the temporary storage unit and the storage unit, in particular the storage transport interface device when provided, the temporary storage unit can have a temporary storage transport interface for the temporary storage or each of the temporary storages, by means of which a document of value is feedable to the temporary storage or the respective temporary storages and/or can be picked from the temporary storage or the respective temporary storages. Said interface, which is an interface device as already explained above, in particular can be formed complementary to the interface device or the interface devices of the storage unit and serves the same purpose.

When the temporary storage unit has at least two temporary storage transport interfaces, preferably a joint drive is provided for the temporary storage transport interfaces. This allows an especially simple structure of the temporary storage unit with reduced mass.

To permit a displacement of the temporary storage unit between the various coupling positions, the transport system and the temporary storage unit preferably are provided with guiding elements complementary to each other, by means of which the temporary storage unit is guided along a predetermined curve when displaced between the coupling positions.

For moving the temporary storage unit the transport system in principle can be provided with any drive elements. Here in particular the following options are advantageous which are to be used alternatively or complementary to each other.

In a first option the transport system together with the temporary storage unit can form an electric linear motor. This alternative is characterized by the number of moving parts being especially small.

In a second option the transport system can comprise a drive unit firmly arranged relative to a base element of the apparatus. This embodiment has the advantage, that the temporary storage unit does not have to have a drive motor for the transport, as a result of which its mass can be reduced.

For efficiently coupling a drive with the temporary storage unit, the transport system of the temporary storage unit in particular can comprise a belt connected with the temporary storage unit and/or a chain connected with the temporary storage unit, which is driven by the drive unit of the transport system. Here as a belt preferably a toothed belt is used. This embodiment allows an especially simple construction of the transport system.

The transport system, however, can have a spindle as well as a drive unit for rotating the spindle and the temporary storage unit can have an element interactive with the spindle, for example a pinion, so that the drive displaces the temporary storage unit by rotating the spindle. This embodiment has the advantage, that a very exact positioning of the temporary storage unit is permitted.

According to another option the transport system can comprise a drive unit connected with the temporary storage unit. This option can permit a very simple structure.

The transport system in particular can have a rack firmly connected with the storage unit and the temporary storage unit can have a pinion engaging into the rack, the rack being driven by the drive unit.

To permit a movement of a document of value inserted by a customer to the checking device, the apparatus preferably is provided with an entrance transport device, by means of which individual documents of value can be transported from an input pocket through the checking device. Said entrance transport device in principle can have any transport elements, for example rolls, rollers, belts, guiding elements, and in particular a motor for driving at least one of the transport elements.

To permit a transport with a low trouble rate from the entrance transport device to the temporary storage unit in the accepting position, the entrance transport device can have an entrance transport interface device, by means of which documents of value transported from the checking device can be transported into the temporary storage unit being in the at least one accepting position. This entrance transport interface can be formed in particular complementary to the temporary storage transport interface and preferably like the storage transport interface devices.

The checking device in principle can have any form. In particular, it only has to permit a checking on a transport in a predetermined transport direction. But the advantage of an especially compact and simple structure can be achieved by the entrance transport device and/or the entrance transport interface device as well as the checking device being designed to transport bi-directionally. But this does not necessarily mean that the checking device also has to allow a check on bi-directional transport. This embodiment further has the advantage that documents of value, which on checking prove to be not acceptable, do not have to be outputted via an output path. They rather can be returned into an input pocket.

When using the apparatus in a payment apparatus, in which the bank notes used for payment are also used for outputting change, the total number of accepted bank notes increases more and more. Therefore, the apparatus is preferably provided with a further storage with a storing position associated thereto, into which documents of value from the temporary storage unit can be stored in the respective storing position, but out of which the documents of value are not passed on to the temporary storage unit. This storage in particular can be used for certain types of documents of value, which in principle are not intended to be re-outputted, for example vouchers or bank notes recognized as not authentic.

In particular in this case the further storage can be disposed in the storage unit. Since such documents of value in many application situations occur only with minor frequency, the storage, like the recycling storage of the storage unit, does not have to be emptied very often, so that an arrangement in storage unit is favorable.

Alternatively, such an input storage can be disposed outside the storage unit, preferably within a safe area, which is disposed separate from an area of the apparatus, in which the storage unit is disposed, and serve as an end storage, in which is stored those part of the fed documents of value recognized as authentic, in particular bank notes, which is not needed for the re-output of change and which therefore has to be emptied more often.

When using the apparatus in a payment apparatus it is often the case that documents of value, in particular bank notes of a certain type, for example of a small denomination have to be outputted more often than they are accepted. To be able to avoid a frequent refilling of the storage unit, the apparatus can preferably have an output storage and/or a retainer for an output storage, from which documents of value can be transported in a singled fashion into the temporary storage unit. In particular, the output storage can be a stacking storage, the stacking storage or the retainer having a singler. Such stacking storages permit an especially space-saving stacking of sheet-shaped documents of value.

During operation the checked documents of value are to be processed in dependence on the result of the check of the checking device. The checking device for this purpose in particular can be formed such that by means of the checking device according to predetermined criteria there can be recognized, whether a document of value is of one of a plurality of predetermined types, for example vouchers or bank notes of predetermined denominations of one or a plurality of different predetermined currencies, and whether the document of value according to the criteria is to be treated as valid or authentic. For this purpose the checking device can have at least one sensor for detecting at least one property of a document of value, whose signals are used for checking the predetermined criteria. For carrying out the check the checking device can be provided with a suitable signal processing device; but it is possible to use a different signal or data processing device of the apparatus for this purpose, which in this respect is assigned to the checking device. In each case signals are generated, which reproduce the result of the checking, for example the type of the document of value and its validity or authenticity. Then the apparatus preferably has a control device, which in dependence on at least the signals of the checking device activates the transport system, so as to by means of it displace the temporary storage unit into coupling positions determined at least partially by the signals, in which a transport of a document of value from the checking device into the temporary storage unit or a transport between the temporary storage unit and the storage unit can be effected. In dependence on the signals, of course, a displace into coupling positions suitable for the transport into a device for outputting documents of value or end cashbox can also be activated.

In principle, the control device can have any form. But preferably it is provided with at least one processor for executing a computer program and a memory, in which a computer program is stored that is executable by the processor. Instead of a processor a plurality of processors and/or controllers and/or microprocessors and/or FPGA connected in parallel or hierarchical can be used.

In particular, for accepting documents of value the control device can be formed such that it activates the transport system such that it displaces the temporary storage unit into the accepting position. The control device can execute this activation in particular by responding to detection signals of a sensor, which recognizes when a document of value is fed to the apparatus. For example, the sensor can be an appropriate light barrier.

Furthermore, the control device can be formed such that by means of the checking device documents of value to be rejected are recognized, and when a document of value to be rejected is recognized, the transport system is activated by the control device to displace the temporary storage unit, in which the document of value is stored, from the accepting position into an outputting position, in which the document of value can be outputted into an output device, and after having reached the outputting position the temporary storage unit is activated such that it outputs the document of value to be rejected. With that it is permitted that documents of value or sheets not acceptable by the apparatus, in particular not recognizable documents of value, are automatically re-outputted, after having been temporarily stored in the temporary storage unit.

Moreover, the control device further can be formed to determine the type and the validity or authenticity of a document of value by means of the checking device, to activate the temporary storage unit in the accepting position such that it stores checked documents of value, and to store data which reproduce the type and information about the validity or authenticity of the document of value as well as its position in the temporary storage unit. With that it is permitted that at first all means of payments in the form of documents of value are accepted, and after that the output of change is carried out.

Furthermore, the control device can be formed to activate the transport system after the end of a feed of documents of value in a storing step in dependence on the data, which reproduce the type and information about the validity or authenticity of temporarily stored documents of value as well as their position in the temporary storage unit, such that the temporary storage unit is displaced into storing positions corresponding to the type of the temporarily stored documents of value, and to activate the temporary storage unit and the storage unit such that the documents of value of the type associated to the storing position are passed on to the storage unit. In this way there can be effected in particular a storage of accepted documents of value according to the type, in particular in case of bank notes recognized as authentic according to the denomination and, optionally, according to the type of currency, so that these are suitable for the output of change. For this purpose the storages of the storage unit in particular can have associated thereto corresponding types of documents of value, so that the control device permits a storing in the storages separated according to type and permits a corresponding re-output. The end of a feed of documents of value can be recognized for example in that the total amount of fed documents of value exceeds a predetermined amount, for example an amount invoiced and to be paid or a predetermined part thereof, or that after expiration of a predetermined time period further documents of value are not fed.

In the apparatus, furthermore, each of at least two storages of the storage unit can have associated thereto a predetermined type of documents of value intended for payout, and the control device can further be formed to determine a number and a type of documents of value to be outputted from the storage unit in the form of bank notes in a payout step in dependence on a payout amount given in the control device and on the number and on the value of the documents of value stored in the storage unit in the form of bank notes of the predetermined type and to activate the transport system such that it displaces the temporary storage unit according to the determined types successively into the corresponding storing positions, and to activate the storage unit and the temporary storage unit such that on reaching the storing positions the predetermined number of bank notes of the corresponding type are stored from the storing position into the temporary storage unit. The amount to be outputted in particular can be entered in the control device or can be determined by it in dependence on an amount to be paid and the value of, optionally, further means of payment fed to the apparatus.

If driven interfaces are provided, the control device can activate these, too, correspondingly.

To permit an especially fast payout of the documents of value to be passed on, the control device, preferably, is further formed to carry out the outputting step before the storing step. Such procedure is permitted by using a suitable temporary storage unit and can considerably shorten the period of a transaction beginning with the deposit of the first document of value until the outputting of the last document of value to be outputted.

When in the apparatus the temporary storage unit is provided with at least a first and a second temporary storage, to which a first or second accepting position is associated, the control device preferably is further formed to activate the transport system such that it displaces the temporary storage unit into a first accepting position for receiving fed documents of value, then to activate at least the temporary storage unit to store the document of value in the first temporary storage corresponding to the first accepting position, after the determination of the type, denomination and authenticity of the document of value, to activate in dependence at least the transport system and the temporary storage unit such that the document of value is stored from the first temporary storage into the second temporary storage, or to output it to a device for outputting documents of value. In this way the temporary storage unit on the one hand can be used to serve as a withholding device, in which a document of value is withhold, until the result of the checking has been supplied. On the other hand, in this way the output of a not accepted document of value can be effected fast and easy.

Moreover, the control device can further be formed such that it, when it has determined the end of a deposit or received a termination signal, which the customer has triggered via an input unit of the apparatus, does not carry out a payout and storing step, but activates the transport system to displace the temporary storage unit from the accepting position into the outputting position. When the temporary storage unit is in this position, it activates the temporary storage unit and the device for outputting documents of value such that the accepted documents of value temporarily stored in the temporary storage unit are re-outputted. This has the advantage, that a customer can undo a wrong deposit and will be returned exactly those documents of value paid in by him.

For covering longer transport path portions, in particular with the first variant of the apparatus, it can further prove to be favorable that a further pair of rolls mounted to be rotatable around a rotation axis is provided, between the rolls of which a document of value is clamped when transported and the rolls of which in a section through the rotation axis have a comblike structure, and which combs with the pair of rolls for the first or second device.

In the following the invention is still further described by way of example with reference to the Figures.

Figure 2:
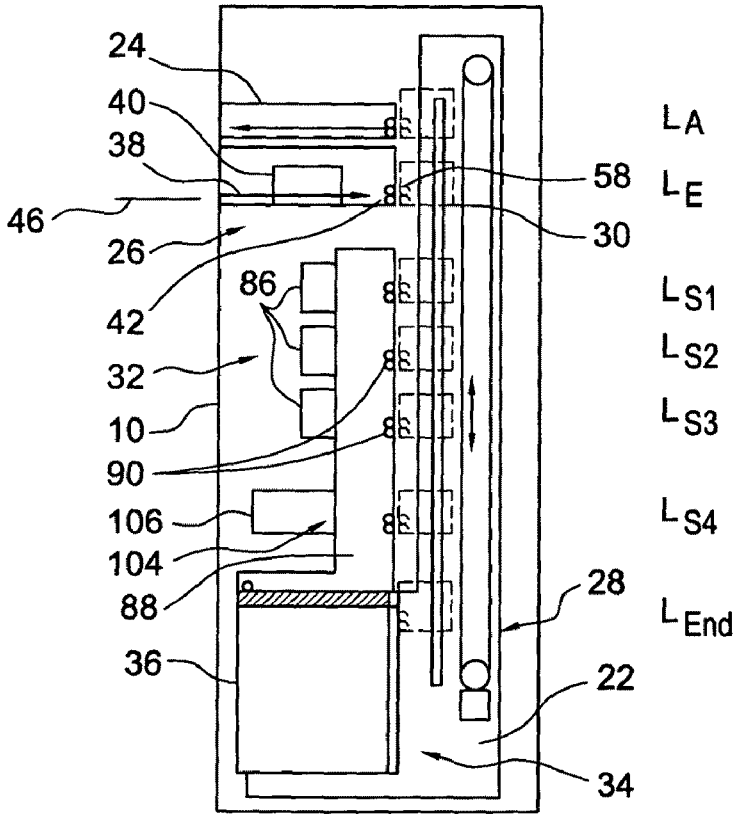
Figure 3:
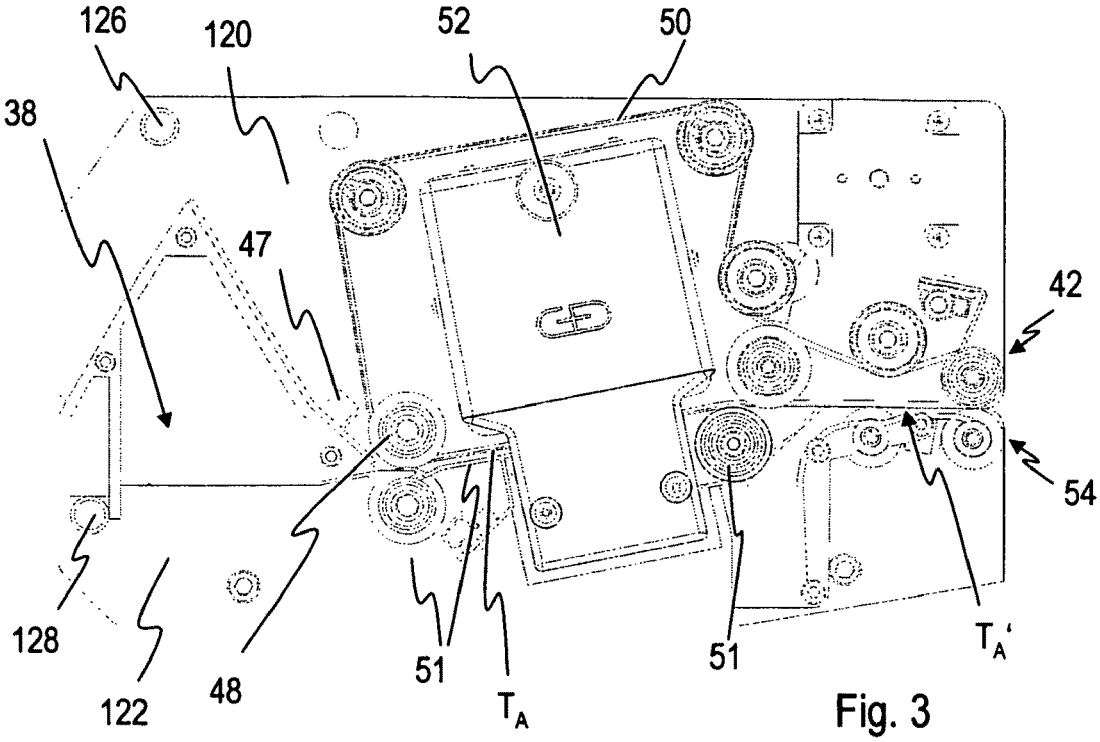
Figure 4:
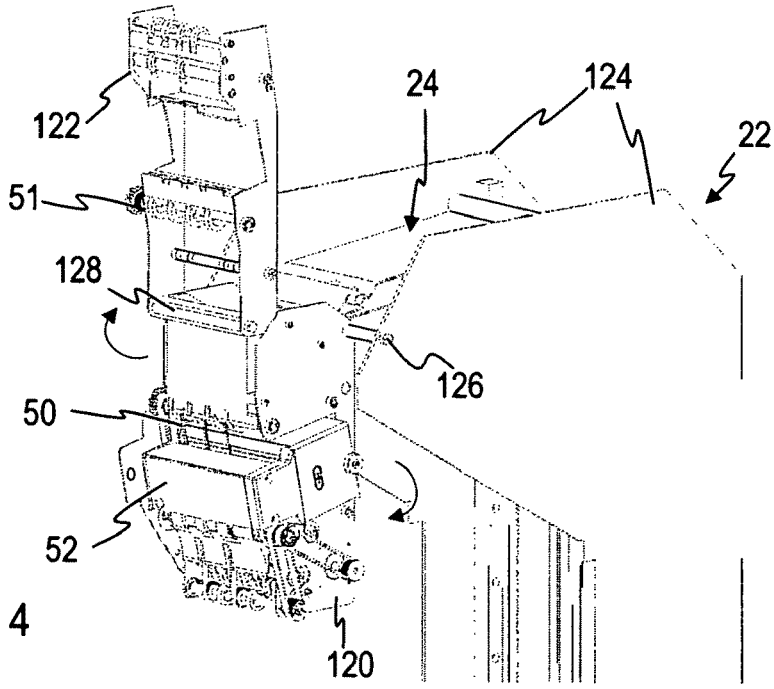
Figure 5:
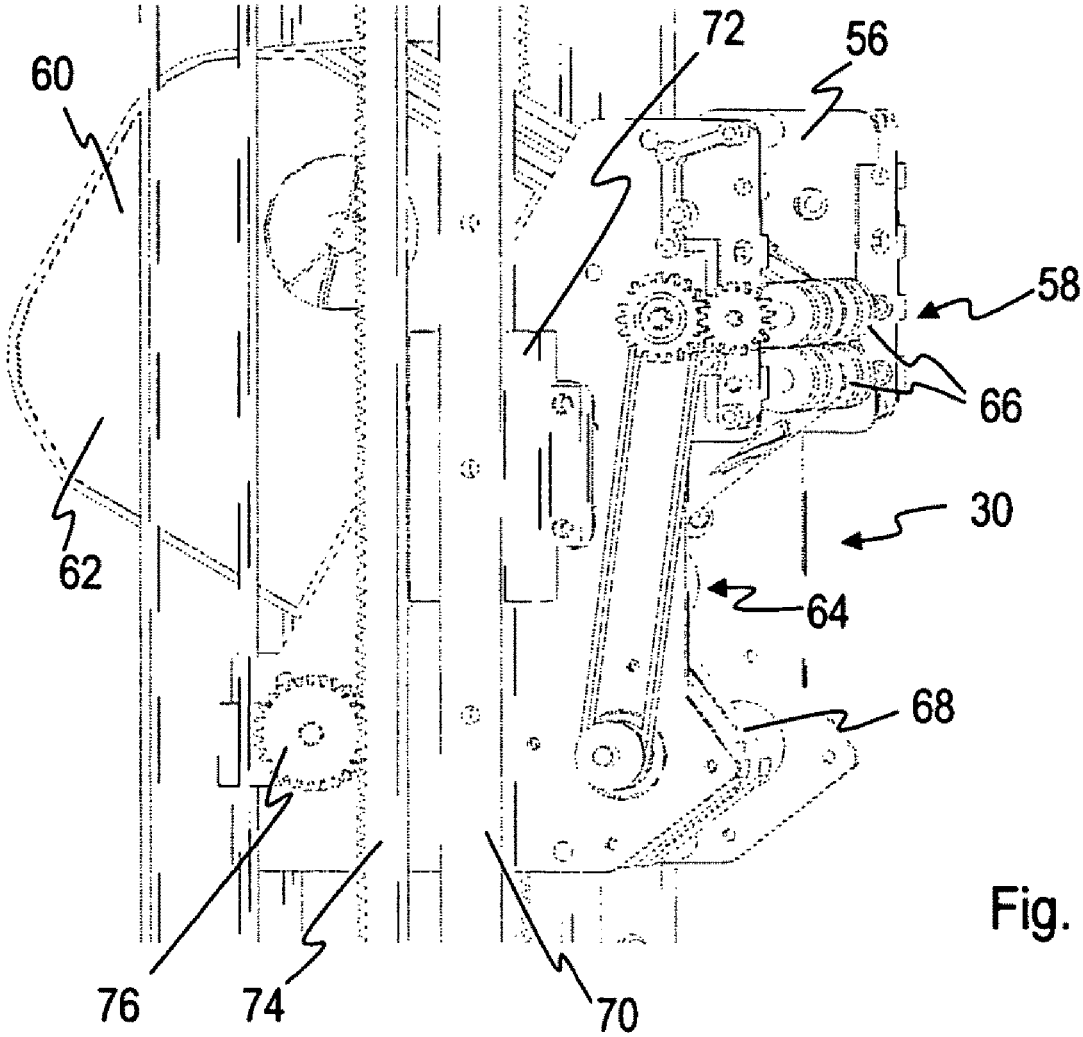
Figure 6:
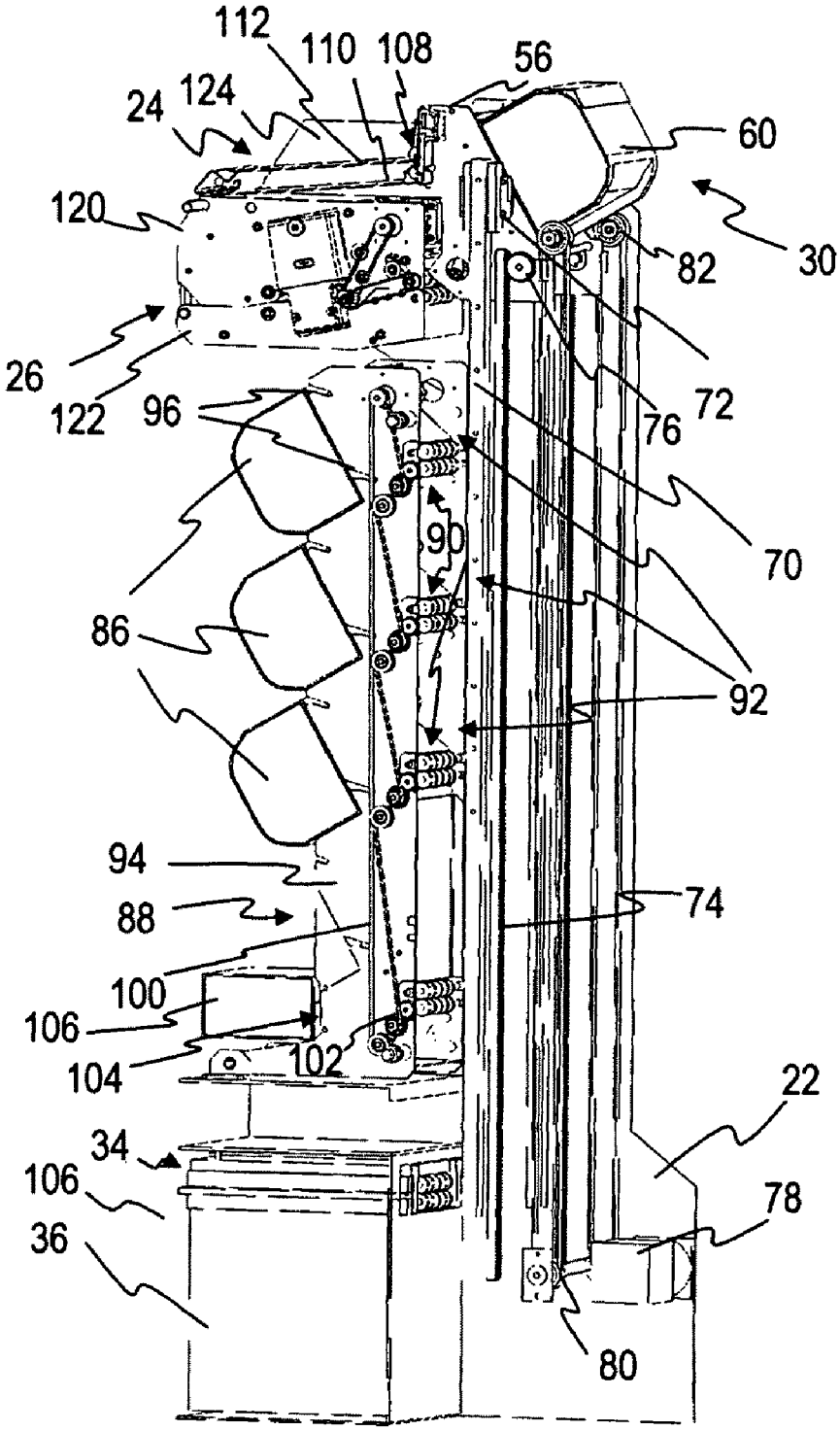
Figure 7:
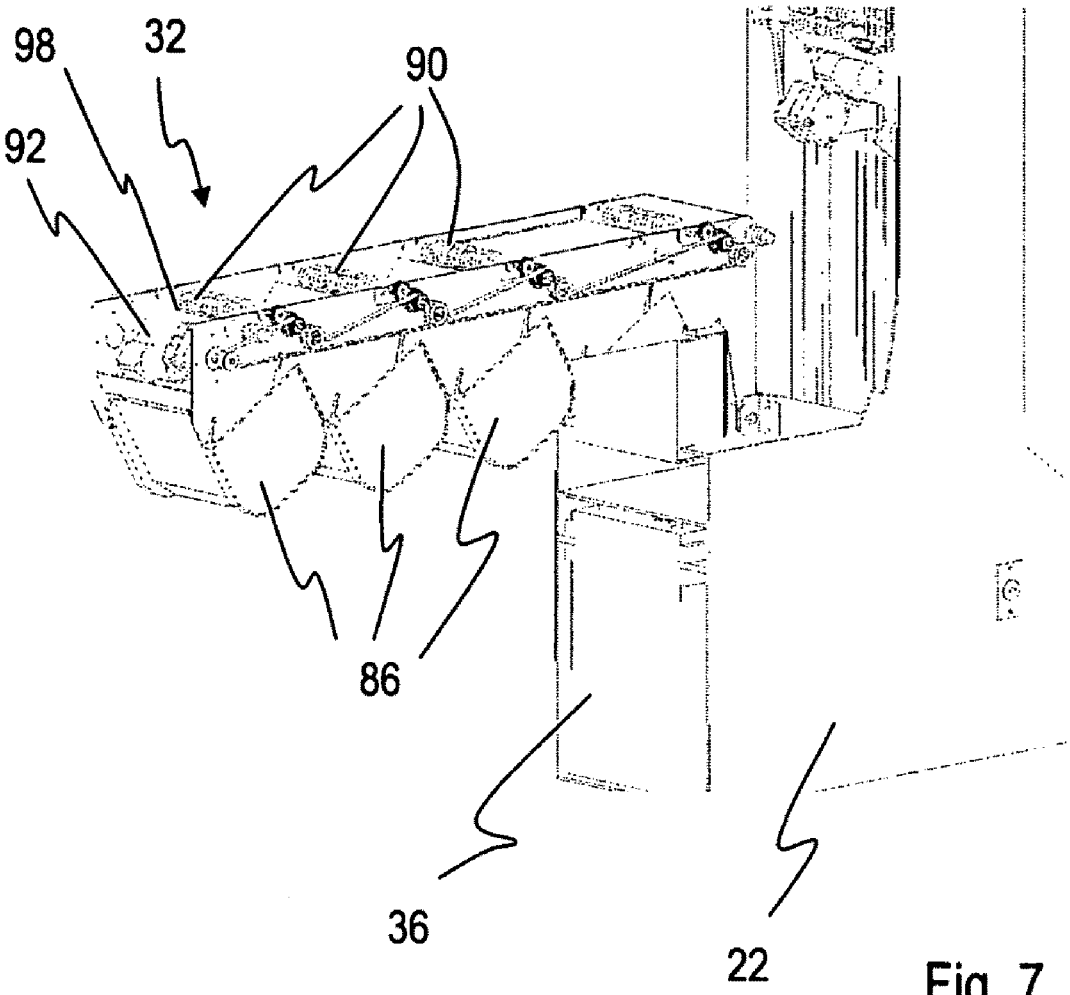
Figure 8A:
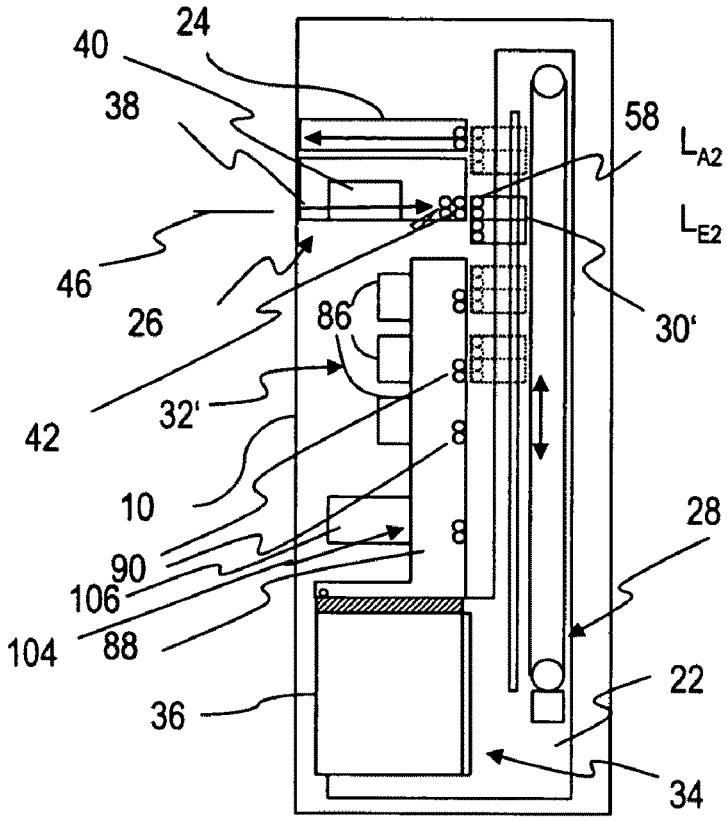
Figure 8B:
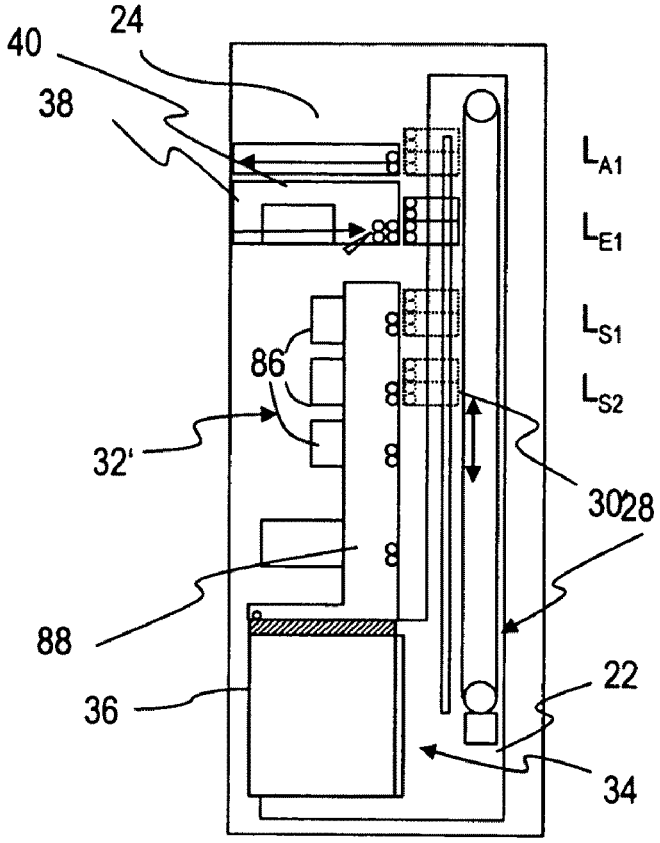
Figure 9:
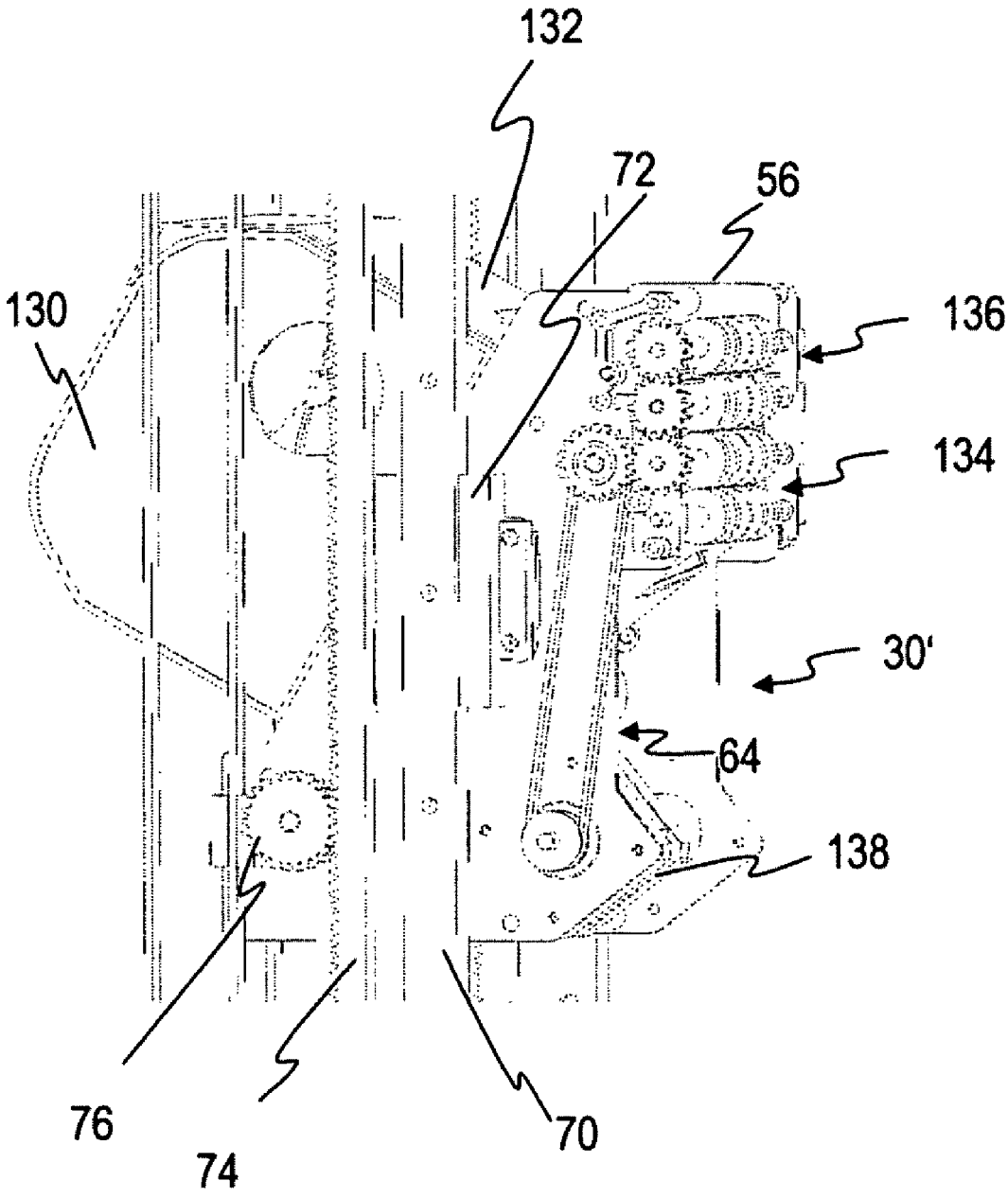
Figure 10A:
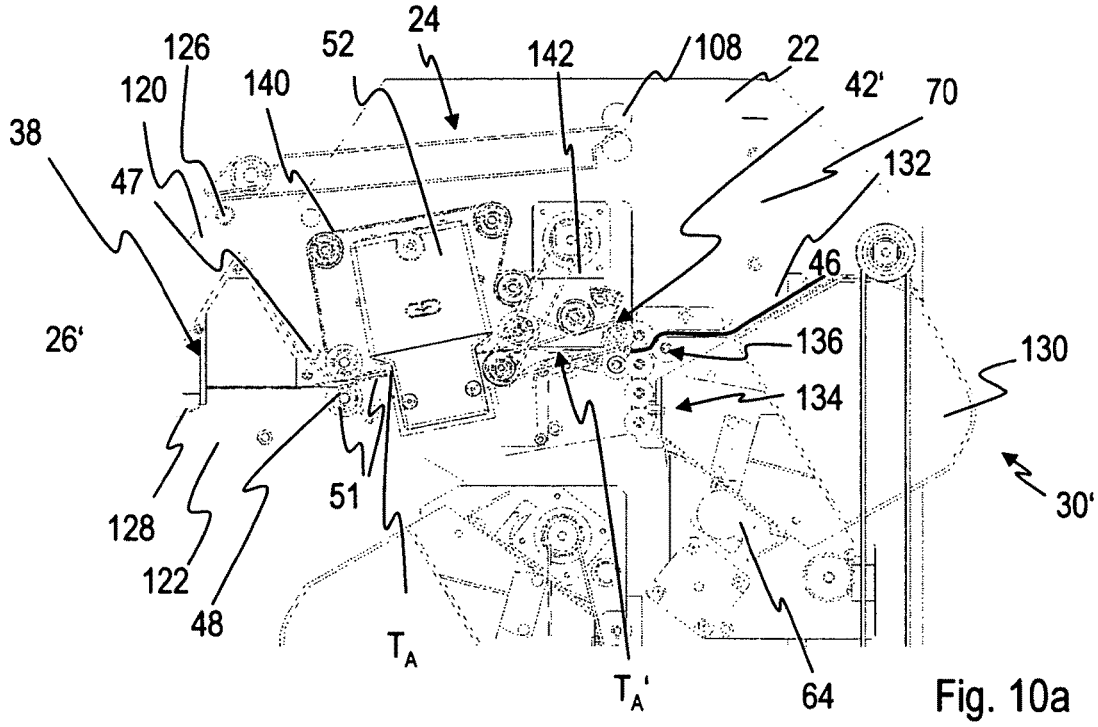
Figure 10B:
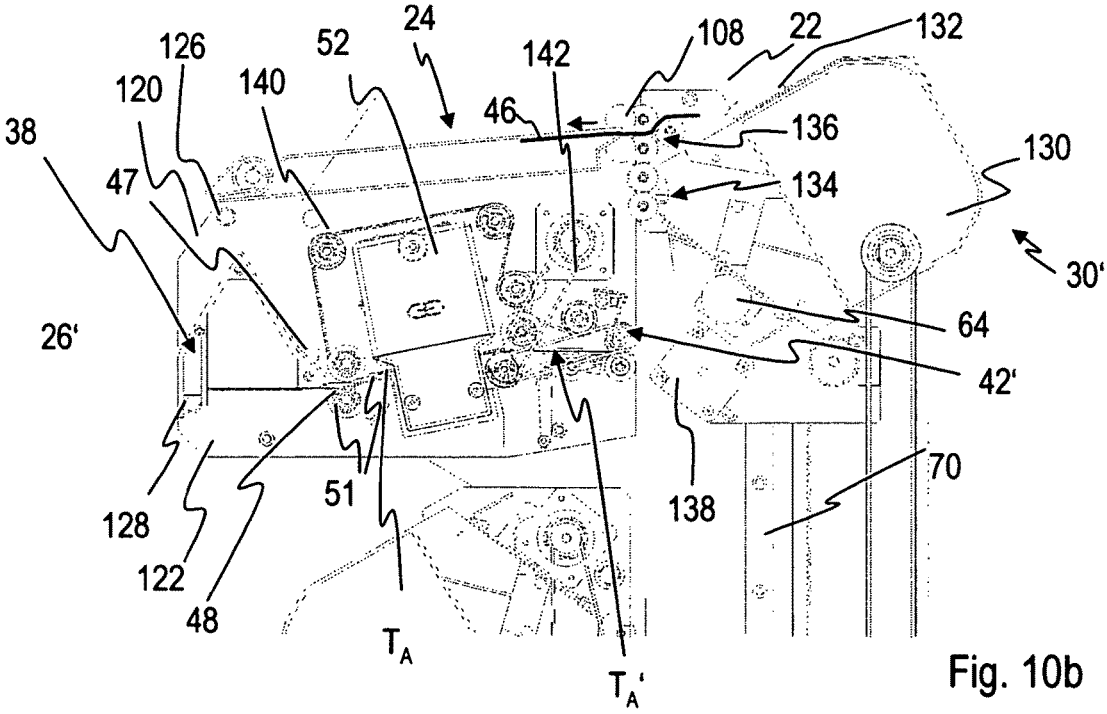
Figure 10C:
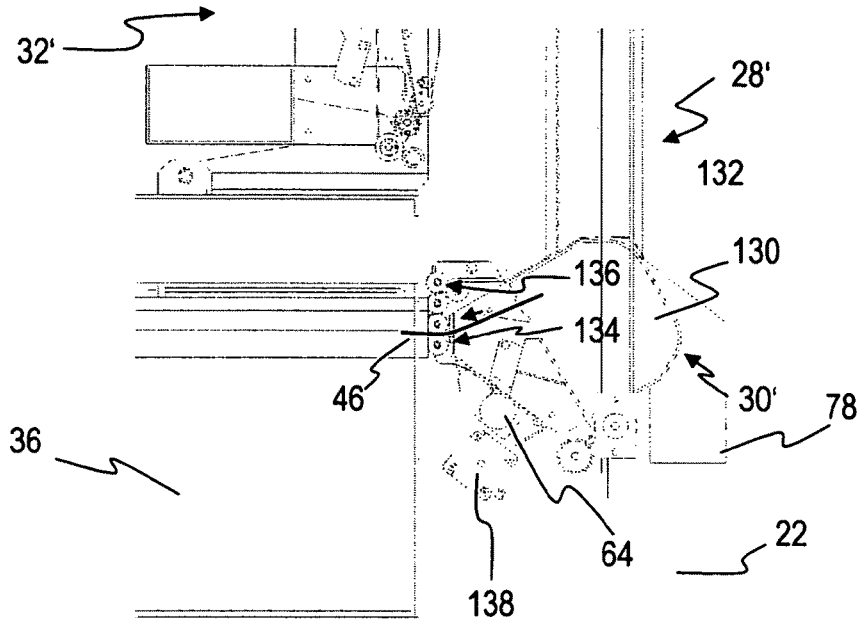
Figure 10D:
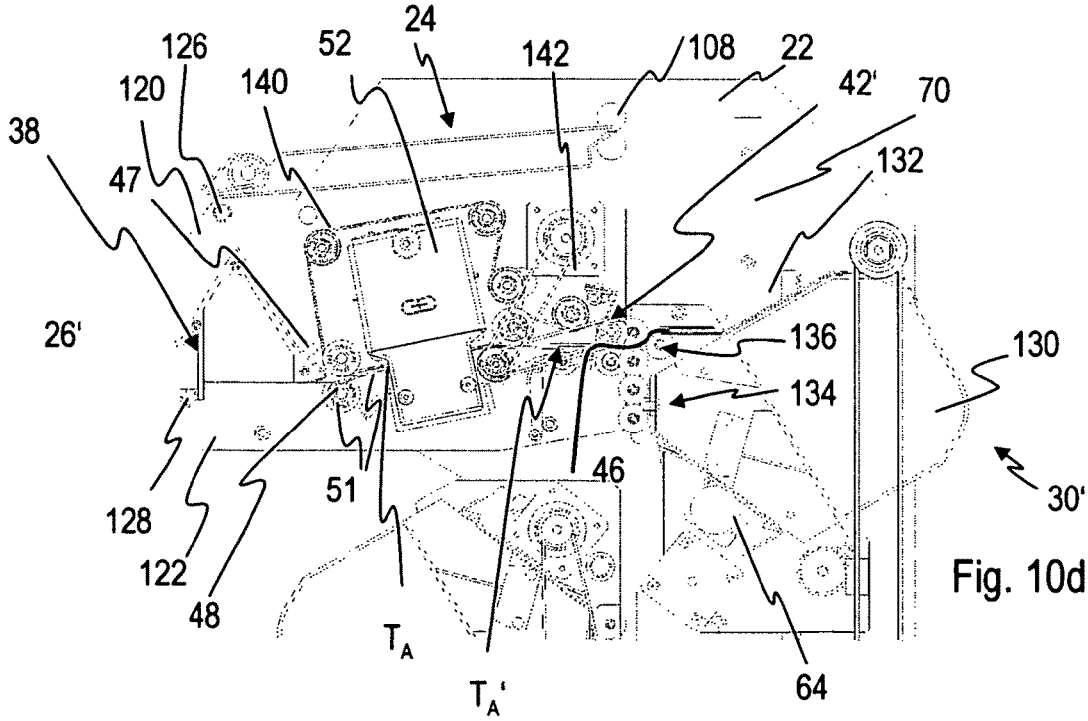
Figure 10E:
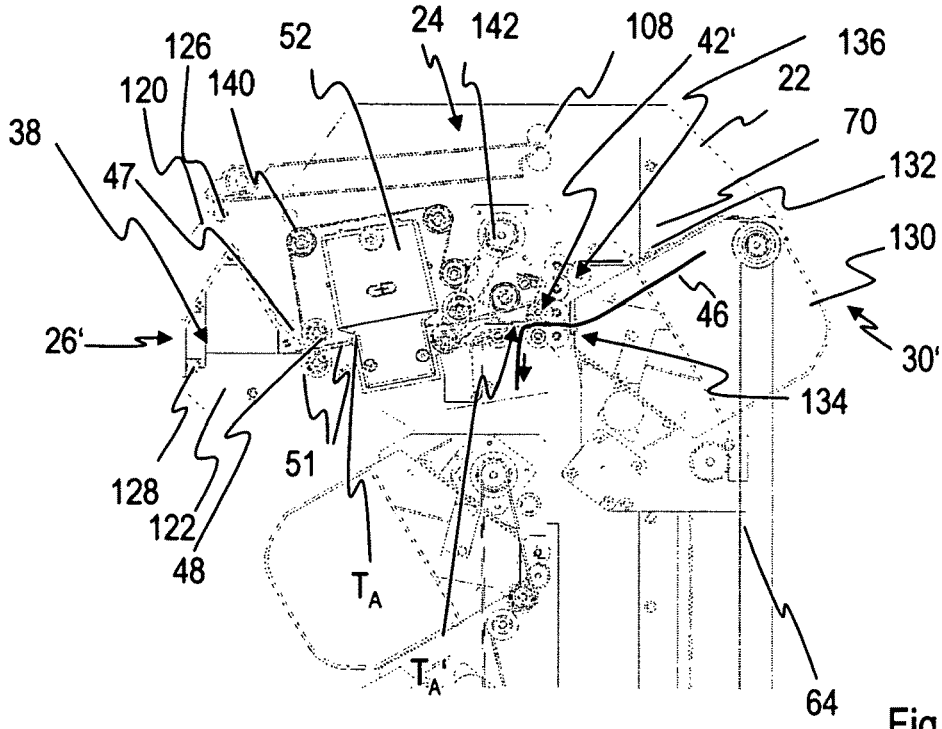
Figure 10F:
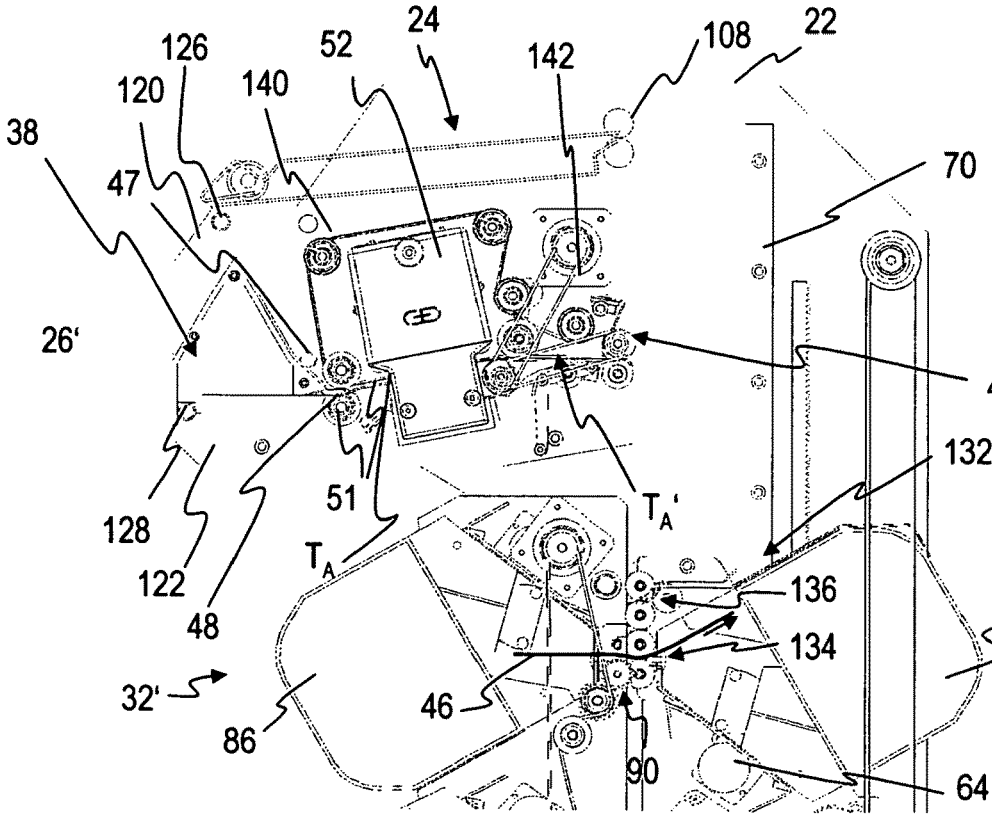
Figure 10G:
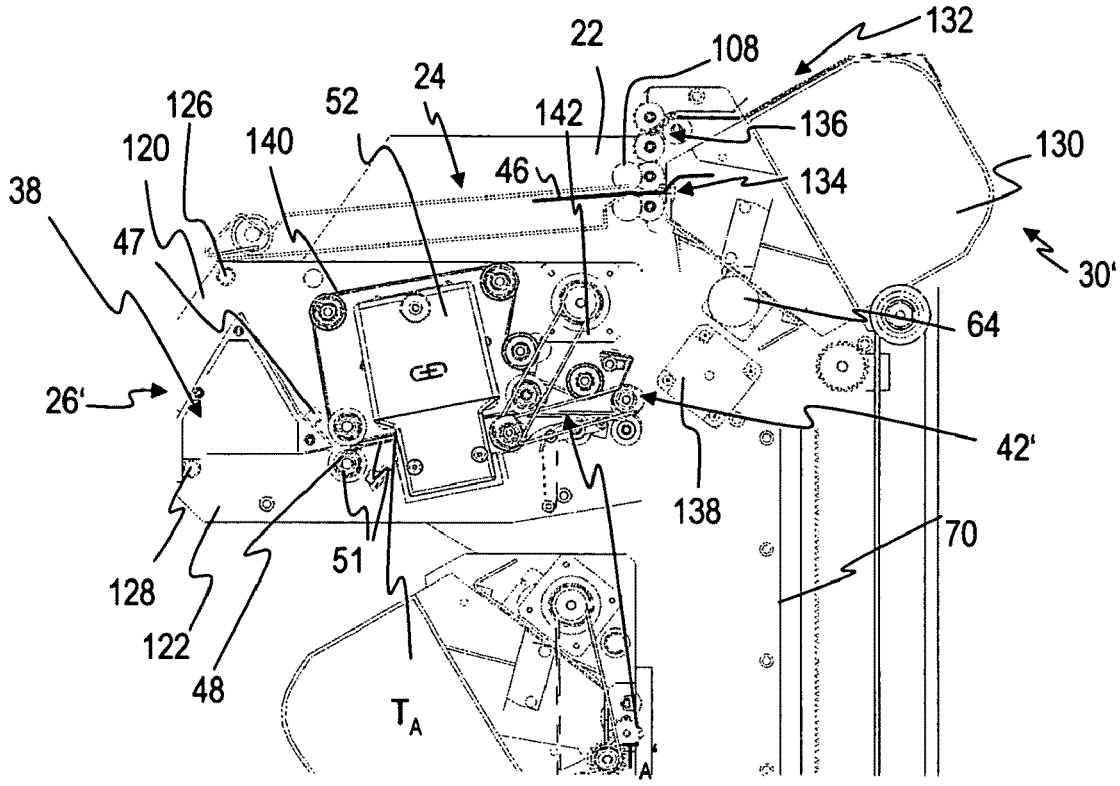
Figure 11:
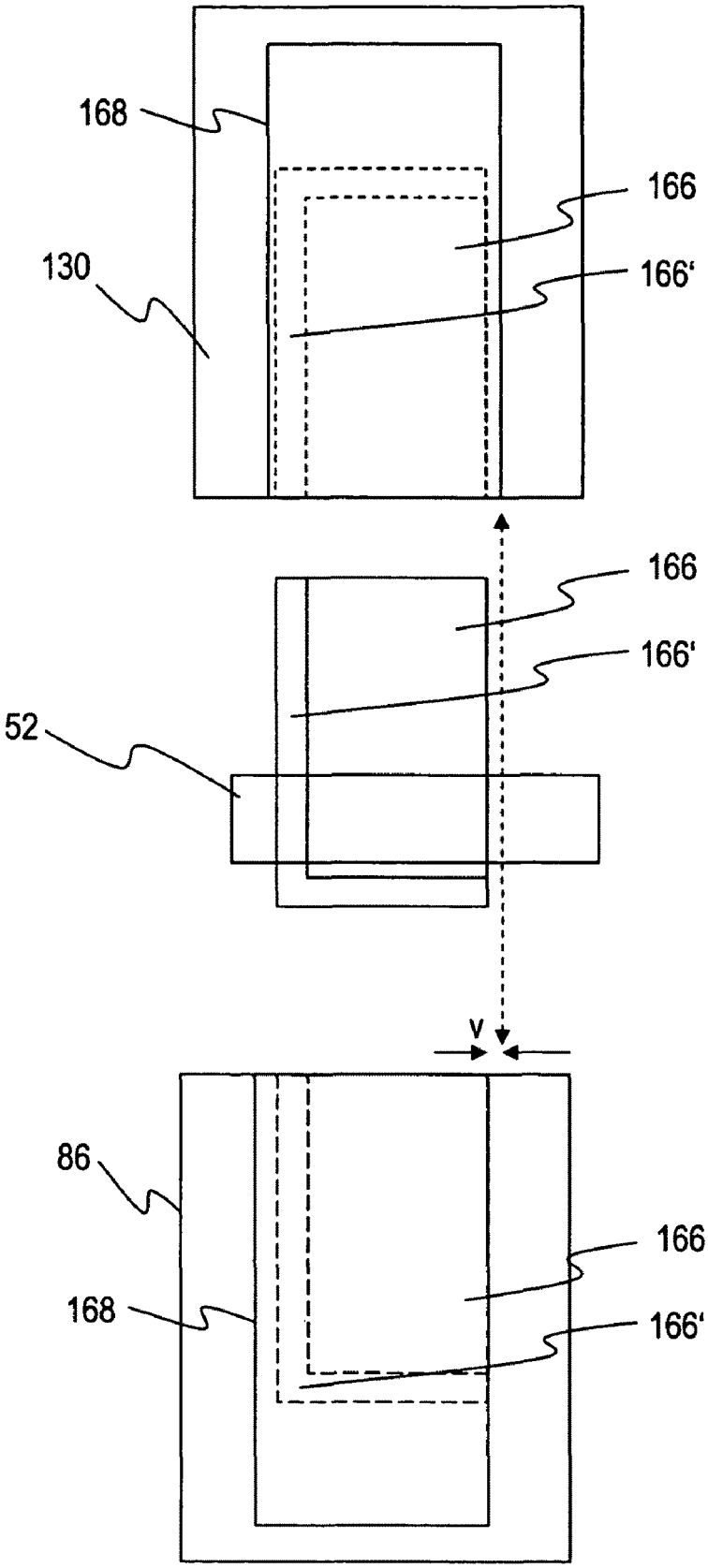
Figure 12:
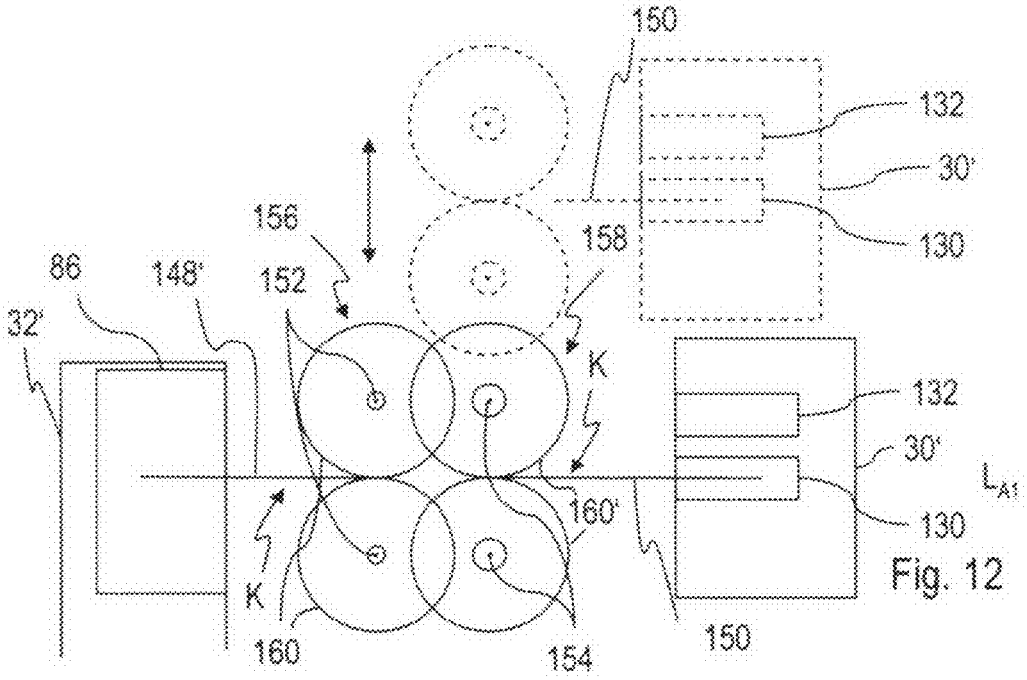
Figure 13:
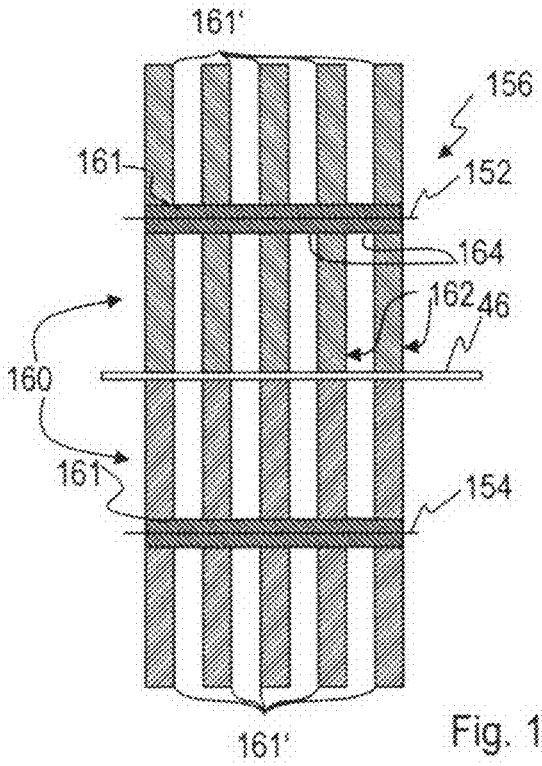
Figure 14:
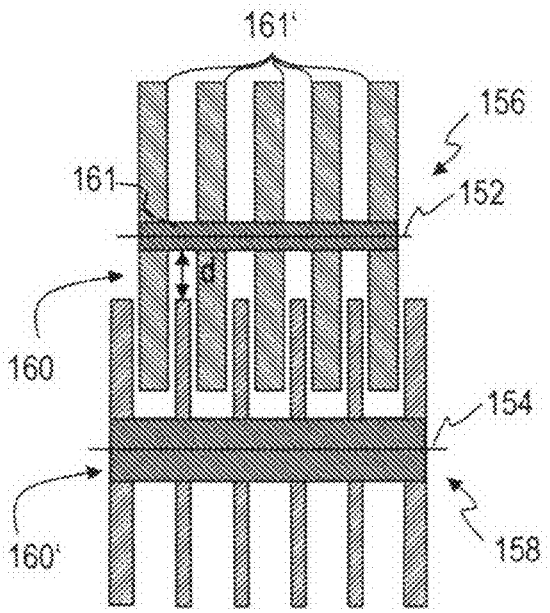
Figure 15:
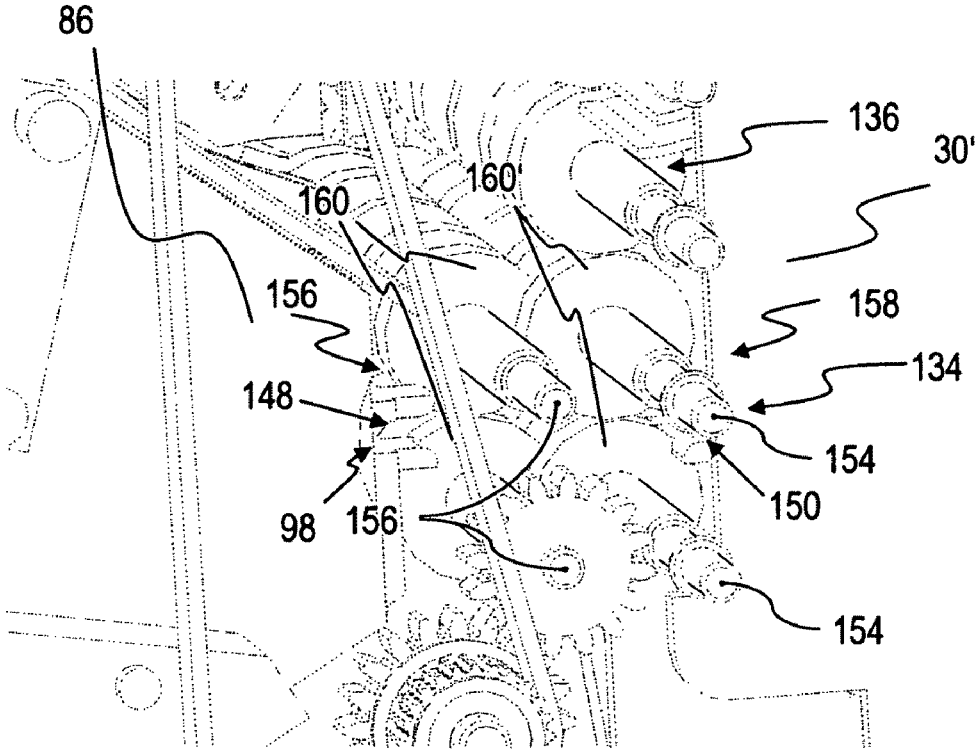
Figure 16:
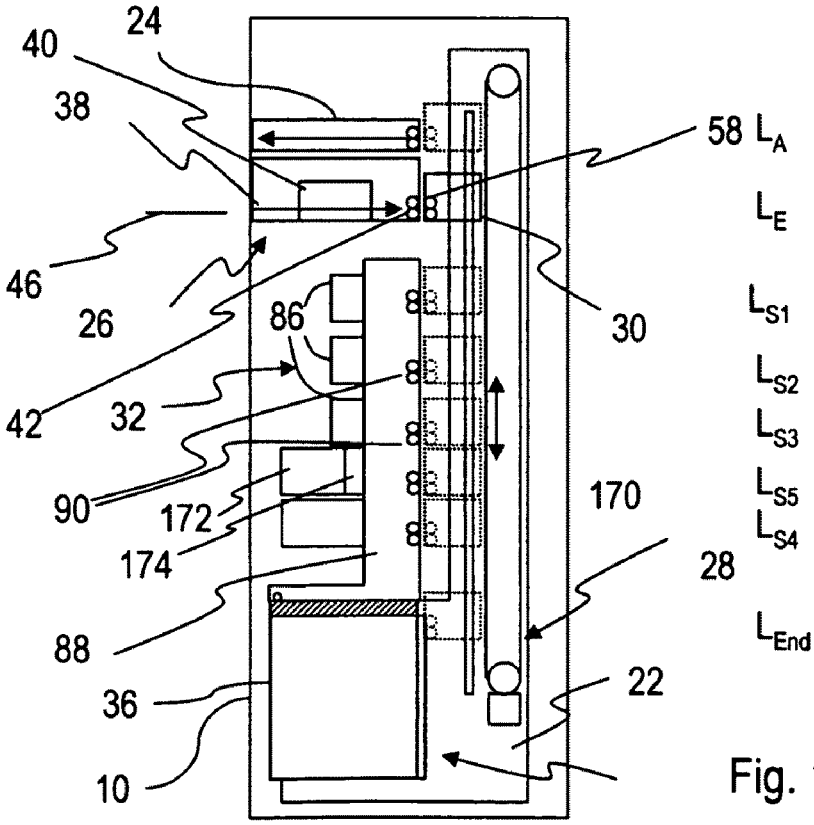
Figure 17:
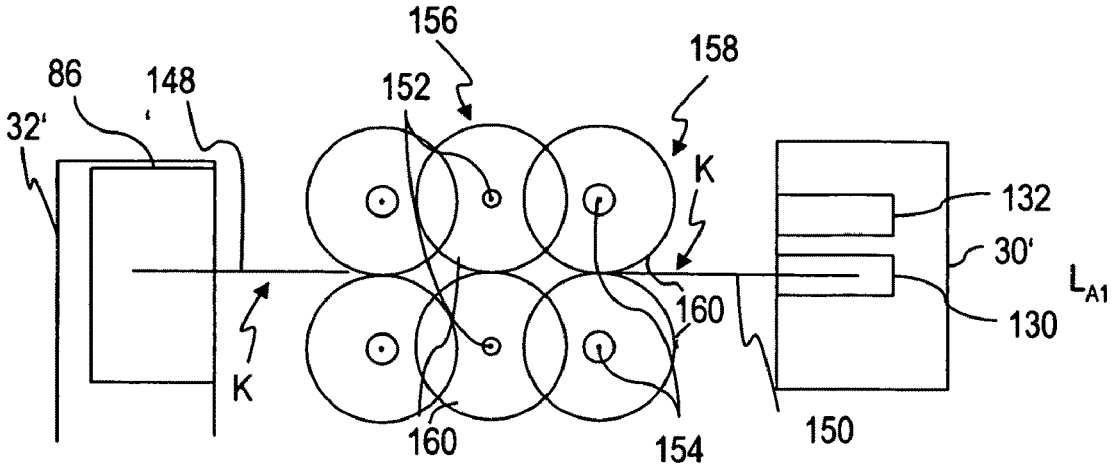

FIG. 1 shows a schematic block representation of a payment apparatus according to a first preferred embodiment, FIG. 2 shows a schematic partially sectional side view of a value document deposit and payout portion, FIG. 3 shows a schematic side view of a checking device and an entrance transport device of the portion in FIG. 2, FIG. 4 shows a perspective representation of a part of the payment apparatus in FIG. 1 with a device for accepting documents of value in an open position, FIG. 5 shows a perspective schematic partial representation of a temporary storage unit of the payment apparatus in FIG. 1 between guiding elements, FIG. 6 shows a perspective schematic partial representation of the module for documents of value of the apparatus in FIG. 1, FIG. 7 shows a perspective schematic partial representation of the module for documents of value of the apparatus in FIG. 1, wherein a storage unit is in an open position, FIG. 8 shows two schematic side views of a module for documents of value of a payment apparatus according to a further embodiment, FIG. 9 shows a perspective schematic partial representation of a temporary storage unit of the module for documents of value in FIG. 8 between guiding elements, FIG. 10 shows various stages of a payment operation using the module for documents of value in FIG. 8, FIG. 11 shows a schematic representation of two bank notes of different widths as well as their position in the checking device and the storages of the module for documents of value in FIG. 8, FIG. 12 shows a schematic representation of an embodiment of an apparatus for handling documents of value, in particular of complementary transport interface devices in a direction parallel to a rotation axis, one pair of rolls being displayed in a coupling position by continuous lines and in a different position by dashed lines, FIG. 13 shows a schematic representation of the transport interface devices in FIG. 12 in a plane through rotation axes of the rolls of a pair of rolls, FIG. 14 shows a schematic representation of the transport interface devices in FIG. 12 in a plane through the rotation axes of the corresponding rolls of the two pairs of rolls, FIG. 15 shows a schematic partial view of two transport interfaces in the apparatus in FIGS. 8 and 9, FIG. 16 shows a schematic block representation of a variant of the payment apparatus in FIGS. 1 and 2 with an additional output storage, and FIG. 17 shows a schematic representation of a further embodiment for an apparatus for handling documents of value, in particular for complementary transport interface devices in a direction parallel to a rotation axis.

A payment apparatus for paying invoices in FIG. 1, which in particular includes an apparatus for accepting and outputting documents of value, in a housing 10 comprises an invoice reader 12, a coin deposit and payout portion 14, a card payment portion 16, a value document deposit and payout portion 18 and a control device 20 partially representing a part of the deposit and payout portions for activating the invoice reader and the mentioned portions and for evaluating the signals of the invoice reader and the mentioned portions. Although corresponding to its function the control device 20 represents a part of the deposit and payout portions, it is shown in FIG. 1 as an independent unit only for clarity's sake.

The payment apparatus and in particular the control device 20 are designed such that invoices can be paid by means of various means of payment, if necessary change being returned. For this purpose the payment apparatus is formed to read an invoice document fed by a customer, for example a printed piece of paper, on which data reproducing the amount invoiced, on which the amount invoiced for example is reproduced in a machine-readable form, in the example in the form of a bar code, by means of invoice reader 12 suitable for reading the data. After that, the payment apparatus accepts from the customer one or a plurality of means of payment for paying the amount invoiced. The three portions 14, 16 and 18 in connection with the control device 20 serve to effect this. Having determined the amount deposited or credited via a card, the control device 20 determines, whether the deposited amount exceeds the amount invoiced and, if necessary, determines the amount of change to be returned to the customer. The control device 20 then activates the coin deposit and payout portion 14 and/or the value document deposit and payout portion 18 such that, to the extent possible, they output documents of value in the form of bank notes and, for the remaining part of the change amount that cannot be paid out by bank notes, coins to the customer. After that, the payment apparatus can produce and output a receipt, which acknowledges, that the amount was paid, or generate a signal and emit it, which says that the amount was paid.

In the context of the present application the invoice reader 12, the coin deposit and payout portion 14, the card payment portion 16 as well as functions of the control device 20 corresponding to said components can be formed in any suitable fashion, in particular in a way known to the person skilled in the art.

In the following there is described in more detail the value document deposit and payout portion 18, which represents an example for an apparatus for the deposit and payout of documents of value or an apparatus for accepting and outputting documents of value and is illustrated very schematized in FIG. 2. On the one hand it is formed to accept documents of value in the form of vouchers of a predetermined type and of bank notes of various types, in the present example bank notes of various denominations of only one currency. In principle, in other embodiments the portion 18 could be formed such that it accepts bank notes of various denominations of various currencies. On the other hand it is formed to output documents of value in the form of bank notes.

At a skeletal structure 22 there are provided, in the example from the top to the bottom, a device for outputting documents of value 24, a combined device for accepting documents of value 26 for taking in and subsequently checking documents of value in the form of bank notes and/or vouchers, a first transport system 28 for transporting a linearly movably guided temporary storage unit 30 for a singled temporary storage of at least two checked documents of value in an in the example vertical direction, as well as a storage unit 32, to be precise an input/output or recycling storage unit. In this embodiment the recycling storage unit 32 is formed such that therein there can be stored bank notes of three different denominations separated according to denominations and that therefrom they can be re-outputted, as well as separated from the bank notes there can be stored vouchers and bank notes recognized as not authentic. Vouchers and bank notes recognized as not authentic are not outputted in a singled fashion during the operating. To each of the denominations as well as to the vouchers and to the bank notes recognized as not authentic there is associated an input/output opening or an input opening, through which the storage or the removal can be effected.

At the bottom of the skeletal structures 22 there is provided a retainer 34 for an end storage 36 with an end storage 36 insertable into the retainer 34 and demountable from the retainer 34.

The temporary storage unit 30, depending on the operation phase, serves to temporarily receive or store checked documents of value from the device for accepting documents of value 26, to pass on temporarily stored documents of value to the storage unit 32, to the end storage 36 or to the device for outputting documents of value 24 and to temporarily receive bank notes to be paid out from the storage unit 32 as well as to output these temporarily stored bank notes to the device for outputting documents of value 24 and for this purpose is displaced by means of the transport system 28 between respective coupling positions, in which a transport of a document of value can be effected between at least one transport path portion of the temporary storage unit 30 and transport path portions of the device for accepting documents of value 26, the storage unit 32, the end storage 36 and/or the device for outputting documents of value 24.

In this example there are provided four different types of coupling positions: on the one hand at least one accepting position $L_E$, in which a document of value can be transported between the device for accepting documents of value 26 and the temporary storage unit 30, storing positions $L_{Si}$ (i=1, 2, 3, 4), the number and position of which corresponds to the number and position of the storage input/output openings of the storage unit 32 and permits an exchange of documents of value between the storage unit 32 and the temporary storage unit 30, an end storage position $L_{End}$, in which documents of value can be transported from the temporary storage unit 30 into the end storage 36, as well as at least one outputting position $L_A$, in which documents of value can be transported from the temporary storage unit 30 to the device for outputting documents of value 24. The coupling positions are shown in FIG. 2 by dashed representations of the temporary storage unit 30 in the mentioned positions.

The operation of the device for accepting documents of value 26, the transport system 28, the temporary storage unit 30 and the storage unit 32 is controlled by signals of the control device 20, which also carries out such control in dependence on signals of sensors and detectors in these devices not described in detail, for example such for monitoring the transport.

In this embodiment the control device 20 comprises a storage 116 and a processor 118 as well as corresponding data or signal interfaces to the electrical devices of the apparatus. In the storage 116 there are stored instructions of a computer program, at the execution of which the control device activates the respective electrical devices of the apparatus by emitting control signals in such a way that these electrical devices carry out the process described in the following.

In this first embodiment the following example of the process is carried out.

A customer feeds an invoice document into the apparatus, from which the control device 20 by means of the invoice reader 12 recognizes the amount to be paid. Then the customer feeds, as already described, means of payment for paying the amount invoiced. Here, only the processing of fed documents of value is to be described in more detail.

When a document of value is fed into the device for accepting documents of value 26, said device takes in the document of value. It emits a signal to the control device 20, which activates the transport system 28 such that it displaces the temporary storage unit 30 into the accepting position $L_E$, provided that it is not already in this position. Then the device for accepting documents of value 26 determines, depending on the embodiment, by means of its own evaluation devices and/or using the control device 20, whether the document of value is a valid voucher or a bank note recognized as acceptable and authentic according to predetermined checking criteria and which value the document of value has. The control device 20 captures signals, which reproduce the type, the result of the check as to authenticity or validity and the value of the document of value, or stores the respective information. In this embodiment after having been taken in and checked the documents of value are supplied to the temporary storage unit 30 in the accepting position $L_E$ and are temporarily stored therein.

When the control device 20 determines, that the last fed document of value was recognized as a valid voucher or as a bank note of a currency acceptable by the apparatus, it stores the value of the document of value and the position in the temporary storage unit 30.

But when the control device 20 determines, that the last fed document of value was not recognized as a valid voucher or was not recognized as a bank note of a currency accepted by the apparatus, the device for accepting documents of value 26 is activated such that for the time being further documents of value are not accepted. Furthermore, it activates the transport system 28 such that the transport system 28 displaces the temporary storage unit 30 into the outputting position $L_A$ and outputs the last temporarily stored document of value via the device for outputting documents of value 24. After that, the control device 20 activates the transport system 28 to displace the temporary storage unit 30 back into the accepting position $L_E$.

Then the control device 20 triggers a further taking in of a document of value, which is treated like the preceding document of value.

During the feed of means of payment the control device 20, based on signals of the device for accepting documents of value 26 and the other portions, permanently determines the total amount of the deposited means of payment and compares it to the amount to be paid. When the total amount exceeds the amount to be paid, it activates the payment apparatus such that it shows an appropriate notice to the customer or person depositing, for example by means of a display device not shown in the Figures, and does not accept any further means of payment.

On the other hand in a storing step the control device 20 in dependence on the position and the type of the documents of value temporarily stored in the temporary storage unit 30, the information about their authenticity and the fill level of the storage unit 32 with respect to the individual denominations, activates the transport system 28 such that it displaces the temporary storage unit into the appropriate coupling positions for outputting the temporarily stored documents of value. Valid vouchers and bank notes recognized as not authentic are transported into the storage, which corresponds to the position $L_{S4}$ and into which only documents of value are inputted, while the bank notes of the three denominations recognized as authentic are stored separated according to denominations in the three appropriate recycling storages. Other bank notes recognized as authentic are stored in the end storage.

The activation is effected according to the temporarily stored documents of value such that the transport system 28 successively displaces the temporary storage unit 30 into coupling positions corresponding to the order of the documents of value in the temporary storage, the type, in the case of bank notes in particular the denomination, and in the case of bank notes of recognized authenticity the document of value which is to be outputted next from the temporary storage unit 30 to the storage unit 32 or, if the denomination of the next document of value to be outputted does not correspond to any of the denominations intended for the storage unit 32 or the storage unit cannot store any further document of value of the denomination, to the end storage 36 a storing position $L_{Si}$ or $L_{End}$ corresponding to the type and the authenticity of the document of value, and the temporary storage unit 30 passes on the document of value to be outputted at that time into the storage unit 32 or the end storage 36. The storage unit 28 or optionally the end storage 36 is activated in an appropriate fashion to receive and store the document of value. With that the storing step is completed.

Before that, at the same time or after that the control device 20 determines in dependence on the number and denomination of the bank notes stored in the storage unit 32, of the amount invoiced and the other fed means of payment, which bank notes are to be returned as change or part of the change.

In a following outputting step it then activates, beginning with the denomination that is stored in the most bottom part of the storage unit 32, the transport system 28, the storage unit 32 and the temporary storage unit 30 such that the temporary storage unit 30 successively displaces into storing positions $L_{Si}$ (i=1, 2, 3) corresponding to the denominations to be outputted at that time and that in these positions appropriate bank notes from the storage unit 32 are stored into the temporary storage unit 30.

After the storage of the last bank note of the change to be outputted into the temporary storage unit 30, the control device activates the transport system 28 such that it displaces the temporary storage unit 30 into the outputting position $L_A$.

After that, it activates the temporary storage unit 30 and, optionally, the device for outputting documents of value 24 to pass on the temporarily stored documents of value to the device for outputting documents of value 24. Based on corresponding signals of the control device 20, the output of the bank notes as change or part of the change is effected. With that the outputting step is completed.

Finally, based on corresponding signals of the control device 20, the transport system 28 displaces the temporary storage unit 30 into the accepting position $L_E$.

A second embodiment differs from the first embodiment only in the programming of the control device 20. Otherwise, the apparatus is unchanged, so that the same reference signs are used and the explanations regarding the structure of the first embodiment apply accordingly.

The only difference in the control device is that already after the temporary storage of the last fed document of value, which was recognized as acceptable when checked, the control device determines the denomination and number of the returned bank notes like in the first embodiment and carries out the outputting step, i.e. in particular activates the transport system 28 such that it displaces the temporary storage unit 30 into the most bottom one of the storing positions associated to the denominations of the bank notes to be outputted. Then it activates the transport system 28, the storage unit 32 and the temporary storage unit 30 such that the temporary storage unit 30 successively displaces into the storing positions corresponding to the individual denominations to be outputted and that there respective bank notes are stored from the storage unit 32 into the temporary storage unit 30.

Then these bank notes are outputted like in the first embodiment. Now in particular the documents of value last taken in are present in the temporary storage unit. After having completed the output the control device carries out the storing step.

For this purpose the control device 20 in dependence on the position and the type of the documents of value temporarily stored in the temporary storage unit 30, the information about their authenticity and the fill level of the storage unit 32 with respect to the individual denominations, activates the transport system 28 such that it displaces the temporary storage unit into the appropriate coupling positions for outputting the temporarily stored documents of value. The activation is effected, as above, according to the temporarily stored documents of value such that the transport system 28 successively displaces the temporary storage unit 30 into coupling positions corresponding to the order of the documents of value in the temporary storage, the type, in the case of bank notes in particular the denomination, and in the case of bank notes of recognized authenticity the document of value which is to be outputted next from the temporary storage unit 30 to the storage unit 32 or, if the denomination of the next document of value to be outputted does not correspond to any of the denominations intended for the storage unit 32, to the end storage 36 a storing position $L_{Si}$ or $L_{End}$ corresponding to the type and the authenticity of the document of value, and the temporary storage unit 30 passes on the document of value to be outputted at that time into the storage unit 32 or the end storage 36. The storage unit 28 or optionally the end storage 36 is activated in an appropriate fashion to receive and store the document of value.

With such a procedure a faster return of change is achieved, since sorting in the already deposited documents of value can be effected after the completion of the payment.

In the following, with reference to the FIGS. 3 to 7, there is described a special, only exemplary embodiment of the part of the value document deposit and payout portion 18 of the two first embodiments not comprising the control device 20. Here, the same reference signs are used for corresponding devices. The part of a value document deposit and payout portion 18 without the control device 20 in the following for simplicity's sake is referred to as module for documents of value.

The device for accepting documents of value 26 along an entrance transport path TE comprises an input pocket 38 for the manual input of single documents of value, a checking device 40 for determining a value of a document of value and for checking the validity or authenticity of a document of value, an in principle optional entrance transport interface 42 as well as an entrance transport device 44 for transporting a document of value 46 pushed into the input pocket 38 along the entrance transport path past the checking device 40 or through it to the entrance transport interface 42. The last entrance transport path portion $T_A'$, which ends in a coupling end at the entrance transport interface 42, in this example extends substantially horizontally.

In the present embodiment the input pocket 38 is provided with a not shown lateral stop, at which when inputting a customer laterally aligns the document of value 46 and further pushes it in.

The entrance transport device 44 is provided with an entrance light barrier 47 for recognizing when a document of value is pushed in, driven transport rolls 48 and transport belts 50, which transport the document of value 46 pushed into the input pocket through the checking device 40, which in this embodiment is designed to recognize bank notes of a predetermined currency and to check them as to their authenticity, which are laterally aligned according to the stop.

For an easy elimination of transport troubles also in the area of the device for accepting documents of value 26 the entrance transport device 44 has two parts 120 and 177, between which there extends the transport path for the documents of value to be transported, which in this embodiment in operation extends substantially horizontally. In this embodiment part 120 is provided with the driven transport elements, in the example transport rolls 48 and transport belts 50, i.e. it forms a drive part, while part 122, which forms the counterpart to part 120, to be precise a pressure part, has non-driven transport elements 51 complementary to the driven transport elements, in the example pressure rolls and rigid guiding elements. In operation these parts 120 and 122 are arranged substantially in parallel to each other and between them they form the transport path for the documents of value.

The entire device for accepting documents of value 26 is hinged swiveling at side elements 124 of the skeletal structures 22 extending in parallel to each other by means of a swivel axis 126 extending at least approximatively orthogonally to the transport direction R of the transport path portion $T_{A'}$ and in parallel to the surface of the transport path determined by the drive part and the pressure part 120 or 122 and being disposed in the area of the beginning of the transport path, the entire device for accepting documents of value 26 being swiveling between an operating position, in which a document of value can be transported along the transport path partially enclosed by the parts 120 and 122 to the temporary storage unit 30 in the accepting position, and an open position, in which a manual access at least to the two ends of the transport path is possible. With that in the embodiment the entire device for accepting documents of value 26, as shown in FIG. 4, can be swiveled downward.

Furthermore, the two parts 120 and 122 of the entrance transport device 44 are fastened in a swiveling fashion relative to each other, so that by swiveling at least one of the parts relative to the other out of an operating position into an open position, the transport path $T_A$ in the entrance transport device 44 can be exposed over its entire length outside the checking device 40. For this purpose in the example the pressure part 122 is hinged at the drive part 120. For this purpose at the drive part 120 is arranged a swivel axis 128 near the front side of the entrance transport device 44 extending in parallel to the swivel axis 126, so that the pressure part 122 can be swiveled upward when the entrance transport device 44 has been swiveled downward. The swivel motion of the entire entrance transport device 44 and the pressure part 122 between an operating position, in which a value document transport is possible, and an open position, in which the transport path is accessible, are effected in one plane, in which also extends the transport direction R given by the transport path $T_A$.

A locking of the parts 120 and 122 in the operating position can be effected by an appropriate locking device, for example a not shown snap-on mechanism.

The electrical connections to other portions and devices of the apparatus here extend in the area of the hinging of the drive part 120, so that when opening the entrance transport device 44 an electrical connection does not have to be disconnected for accessing the transport path. This has the advantage, that even technically untrained persons can easily eliminate malfunctions that may occur, without reducing the electrical function.

The checking device 40 (cf. FIG. 3) comprises a device for detecting vouchers, not shown in the Figures, which recognizes vouchers, determines their validity and value and emits corresponding signals to the control device 20, in the example a bar code reader for reading an encoded bar code and decrypting the data represented by the bar code, which reproduce the value of the voucher. The checking device 40 is further provided with a bank note checking device 52 for determining the type, in particular for recognizing a predetermined currency and the denomination of bank notes and for checking the authenticity of bank notes according to predetermined criteria. For example, the bank note checking device CashRay 90 distributed by the applicant can be used. Then the checking device 40 emits check signals according to the result of the check to the control device 20, so that control device 20 has data at its disposal, which among other things reproduce the type, the validity or authenticity and the value of the document of value.

Then the checked document of value 46 is transported to entrance transport interface 42, which serves to transfer the document of value to the temporary storage unit 30 and for this purpose is provided with a pair of driven rolls 54. The position of these rolls at least partially sets an accepting position for temporary storage unit 30, in which temporary storage unit 30 has to be to receive a document of value outputted from the entrance transport interface 42.

For the singled temporary storage of at least two documents of value (cf. FIG. 5) the temporary storage unit 30 is provided with a temporary storage transport interface 58 disposed at a base body 56, a downstream temporary storage 60 for receiving, singled temporary storing and outputting singled documents of value via a transport path portion $T_Z$, in the example a winding storage 62 formed as an exchangeable module, and a motor 64 tightly connected with the base body 56 for operating the winding storage 62.

The temporary storage transport interface 58 is provided with a pair of transport rolls 66 as well as with a drive unit 68 coupled with the pair of transport rolls 66 by means of a belt and a toothed gearing, the drive unit 68, like motor 64, being at least indirectly activated by control device 20 and for this purpose is connected to it via appropriate devices for signal transmission.

The temporary storage unit 30 is displaceable between various coupling positions (cf. FIG. 6) by means of the transport system 28 along a linear, in the example substantially vertical direction, depending on the inclination of the floor space of the apparatus.

For guiding the temporary storage unit 30 along a linear direction, in this embodiment the transport system 28 is provided with guide rails 70 fastened at the skeletal structure 22 in parallel to each other, and the base body 56 displaceable between the guide rails on both sides is provided with complementary guide devices 72, in the example guide carriages, into which the guide rails 70 engage.

Furthermore, for guiding the transport system 28 optionally is provided with a pair of toothed racks 74 fastened in parallel at the skeletal structure 22, between which the temporary storage unit 30 is movable. At the base body 56 of the temporary storage unit 30 on opposite sides are disposed toothed wheels 76 complementary to the toothed racks 74, which engage into the toothed racks 74 and prevent a jamming of the temporary storage unit 30.

For moving the temporary storage unit 30 in this embodiment there is provided a drive unit connected with the skeletal structure 22, which moves the temporary storage unit 30. Here the coupling is effected via a synchronous belt drive.

To be precise (cf. FIG. 6), with the skeletal structure 22 a drive unit 78 is provided at one end of the motion path of the temporary storage unit 30, which drives a shaft 80 with a gear pair, and at the other end is provided an axle 82 with a gear pair corresponding to the gear pair at the shaft 80. Around the gear pairs run two endless toothed belts 84, which are fastened at the base body 56 of the temporary storage unit 30, so that by moving the toothed belts 84 the temporary storage unit 30 is movable upward and downward along the skeletal structure 22 relative to the device for accepting documents of value 26, the device for outputting documents of value 24 and in particular also to the storage unit 32 and the end storage 36.

The storage unit 32 is provided with storages 86, in this embodiment three recycling storages for accepting, storing and outputting documents of value, for example winding storages, with an L-shaped retaining device 88 for the recycling storages 86 as well as, held at the retaining device 88, with storage transport interfaces 90 for each of the recycling storages 86, by means of which documents of value can be transported to and from between the respective recycling storage and the temporary storage unit 30 being in a suitable coupling position in front of it. Although in principle not necessary, in this embodiment the recycling storages are formed equally.

The L-shaped retaining device 88 is provided with through retainer openings 92 for accommodating the recycling storages 86, which in the example are formed by the space between two L-shaped side cheeks 94 disposed in parallel to each other. The recycling storages are formed as modules to be removed and inserted without tools and each is detachably fastenable at the retaining device 88 by means of first fastening devices, in the example fastening slots 96 in the side cheeks 94 and first fastening devices complementary to the first fastening devices, in the example pins at the side walls of the recycling storage 86. With that they can be exchanged very easy.

The holding device of the recycling storages 86 here is formed such that the recycling storages 86 each are facing the transport system 28 with an input/output opening 98 for documents of value to be stored or already stored, which is located in a storage transport path portion $T_S$ ending at a coupling end at the storage transport interface, while an insertion or remove of the recycling storage can be effected from the opposite direction.

The storage transport interfaces 90 in operation disposed between the input/output openings 98 and the transport system 28 each comprise transport elements, which are jointly driven. In the example said transport elements are pairs of rolls 102 driven by a joint belt drive 100, which are mounted in the retaining device 86, in the example in the side cheeks 94. The storage transport interfaces 90, in the example the pairs of rolls 102, set storing positions, which the temporary storage unit 30, to be precise the temporary storage transport interface, has to assume for the exchange with the respective recycling storage, so that an exchange of a document of value between the temporary storage unit 30 and the respective recycling storage can be effected.

The side cheeks 94 are disposed such that the long legs with the fastening slots 96, and with that in particular the storage transport interfaces with their opening for documents of value facing the transport system 28 are disposed at least approximatively in parallel to the possible motion path of the temporary storage unit 30.

In this embodiment, optionally, there is provided a further retainer 104 for a cassette 106 that serves to receive vouchers and to receive bank notes, which on checking were classified as not authentic. For these, too, a storage transport interface is provided, which is formed and disposed corresponding to the other storage transport interfaces of the storage unit 32.

Furthermore, the retaining device 88 is hinged swiveling around an axle extending in the same direction as a bottom edge extending transversely to the motion direction of the temporary storage unit 28, so that the storage unit 32 can be swiveled to and from between an operating position, in which the storage transport interfaces are aligned such that a transport to the temporary storage unit in one of the storing positions is possible, and an open position, in which the storage transport interfaces are accessible.

All electrical connections of electrical devices of the storage unit 32, for example not shown electrical motors for driving the recycling storages 86 or the storage transport interfaces 90, to other parts of the apparatus, in particular the control device 20 are effected via a not shown cable tree, which in the area of the swivel axis runs from the storage unit 32 to the skeletal structure 22.

This arrangement permits on the one hand, that the recycling storages 86 can be easily exchanged, without having to move more parts than a door of a housing. On the other hand, for eliminating transport troubles the retaining device 88 with the recycling storages 86 and the cassette 106, i.e. the storage unit 32, can be easily swiveled away from the transport system 28 (cf. FIG. 7). Except for the accepting interfaces, with that all other interfaces for transferring documents of value between the temporary storage unit 30 and the recycling storages 86 or the cassette 104 are directly easily accessible. Any electrical connections do not have to be disconnected, so that a jam can be eliminated very easily.

Below the storage unit 32 in a safe area 106 there is provided the retainer 34 for the end storage 36 serving as an end cashbox, which likewise is provided with a storage transport interface, which likewise defines a storing position and by means of which bank notes can be transported from the temporary storage unit into the end cashbox. In the example a free-fall cassette is provided as an end storage 36, the retainer 34 being formed accordingly.

The safe area 106 is separated from the housing area, in which the storage unit is disposed, so that an access to the safe area can be effected independently of the other housing area. The two areas are provided with separate lockings, which only can be unlocked with appropriate keys or authorizations. In this way the end storage can be removed, without a manipulation at the parts of the apparatus being possible. On the other hand, there can be ensured, that when opening the apparatus for eliminating malfunctions an access to the content of the safe area is prevented.

In this embodiment the recycling storages 86, the retainer 104 or the cassette 106 accommodated therein and the retainer 34 for the end storage 36 are formed such that the entrance transport path, the winding storage 62 and the mentioned storages or cassettes lie in one plane with their input and/or output openings, i.e. not offset.

For outputting bank notes or documents of value recognized as not acceptable during the check by the checking device 40 serves the device for outputting documents of value 24 disposed above the checking device 40, to which, likewise, documents of value can be outputted from the temporary storage unit via an output transport interface 108, which defines at least one outputting position of the temporary storage unit 30. In this embodiment for this purpose is provided a simple output device having a bottom 110 and a spring-mounted lid 112, at the end of which is formed a clamp roller 114 (cf. FIG. 4).

In a variant of this embodiment instead of a checking device, which is formed to check laterally aligned documents of value, a checking device is used, which checks documents of value, which with respect to the transport path are transported in a centered fashion. Between the input pocket and the checking device the entrance transport device then preferably is provided with a device for centering the documents of value.

A further embodiment is shown in FIGS. 8 to 11. It differs from the first embodiment by the formation of the temporary storage unit, the formation of the entrance transport device, the arrangement of the recycling storages in the storage unit and a corresponding modification of the control device. For unchanged parts of the apparatus the same reference signs are used and the explanations and variations regarding the above embodiments are applicable accordingly here.

The value document deposit and payout portion 18' for clarity's sake shown only very schematically in FIGS. 8*a* and 8*b* is provided with a temporary storage unit 30' (cf. FIG. 9), which has two temporary storages 130 and 132 and corresponding temporary storage transport interfaces 134 and 136.

The temporary storage 132 of the two temporary storages 130 and 132 is a temporary storage for one single document of value and the temporary storage 130 is a temporary storage, in particular a winding storage, for at least two documents of value which can be inputted into or outputted from the temporary storage 130 only in a singled fashion one after the other.

Depending on which of the temporary storages is to be used, for each of the entrance transport interfaces, storage transport interfaces and output transport interfaces there are two possible coupling positions, i.e. accepting, storing or outputting positions of the temporary storage transport device 30'.

This is shown in FIGS. 8*a* and 8*b* for clarity's sake with reference to the example of the accepting positions $L_{E1}$ and $L_{E2}$. Depending on which of the temporary storages 130 or 132 is to be used, the transport system 28 displaces the temporary storage unit 30' for using the temporary storage 130 together with the temporary storage transport interface 134 into the accepting position $L_{E1}$ or for using the temporary storage 134 together with the temporary storage transport interface 136 into the accepting position $L_{E2}$. The same applies to the other coupling positions.

A detailed representation of the temporary storage unit 30' is shown in FIG. 9, which corresponds to FIG. 5. The temporary storage 130 can be formed, like in the first embodiment, as a winding storage, while the second temporary storage 132 is a storage for one single document of value, in the example a storage space on the temporary storage 130. The temporary storage transport interfaces 134 and 136 are formed identically. Furthermore, they are driven by a joint drive unit 138 of the temporary storage unit 30', embodiments with a separated drive also being conceivable.

In this embodiment the temporary storage 132 formed as a single storage is formed such that in it there can be stored all types of documents of value admissible for payment, in particular such having the greatest expansion transverse to the transport direction. The temporary storage 130, however, only has to be formed to receive the documents of value, which are stored in the storage unit.

To permit a re-storing between the temporary storages 130 and 132, the entrance transport device 44' compared to the entrance transport device 44 is changed in two points. On the one hand the entrance transport device 44' (cf. FIG. 10*a*) is provided with a modified entrance transport interface 42' and on the other hand with a first transport drive unit 140, which drives the transport elements of the entrance transport device 44' that is unchanged compared to the entrance transport device 44 except for the drive and the entrance transport interface 42', as well as with a second transport drive unit 142, which drives the entrance transport interface 42'.

Now the entrance transport device 44' in the transport path is provided with a diverter 144 disposed downstream of the checking device 40, which can be set to and from between a first position, in which a document of value can be transported from the checking device 40 through an entrance transport path portion $T_{A'}$ via the entrance transport interface 42' to the temporary storage unit 30' in one of the accepting positions (cf. FIG. 10 *a*), and a second position, in which a document of value can be transported from the temporary storage unit 30' in one of the accepting positions in a holding area 146 below or beside the checking device 40 (cf. FIG. 10*c*).

The second transport drive unit 142 connected with the modified control device 20' for signal transmission and activated by it is formed such that in dependence on signals of the control device 20' it can transport a document of value to the temporary storage unit 30' or from this unit into the holding area 146, in this embodiment the position of the diverter 144 being changeable by a not shown diverter drive activated by the control device 20'.

The storage unit 32' differs from the storage unit 32 only in that at least one of the recycling storages 86, namely the one for the bank notes of the smallest dimension transverse to the transport direction, is disposed relative to the temporary storage 130 of the temporary storage unit 30' in the corresponding storing position such that the middle of stored bank notes is offset transversely the transport direction to or in the recycling storage relative to the middle of bank notes of the same type stored in the temporary storage 130. The offset is chosen such that on temporary storing bank notes in the temporary storage 130, during which the bank notes with a predetermined edge are equally aligned in parallel to the transport direction, and on transferring the bank note of the type predetermined for the recycling storage 86 to the recycling storage, the distance of the middle of the bank note in the temporary storage to the middle of the bank notes of the same type stored in the recycling storage is reduced.

In this embodiment the recycling storages 86 all are offset by the same amount in the same direction. In a different variant the offset of the recycling storages 86 can be differently chosen in dependence on the bank note types to be stored in these, for example denominations of bank notes of the same currency.

This arrangement is illustrated once more in FIG. 11, in which bank notes 166, 166' of two different widths are shown by dashed lines in the transport path from the checking device 40 via the transport interfaces to the winding storages 130 of the temporary storage unit 30' in the accepting position $L_{A1}$ with continuous lines, in the winding storage 130 and in one of the recycling winding storages 86, which in the Figure for clarity's sake is drawn offset along the transport direction R.

By aligning the bank notes along their longitudinal edge, they reach the winding storage 130, in which they are successively stored also aligned along their longitudinal edge. With that in the winding 168 they are disposed asymmetric. With only few bank notes the storing is not influenced thereby. During the transport into the recycling storages the position in the plane shown in FIG. 11 does not change, so that the bank notes without the offset would also be stored asymmetrically along their longitudinal edge in the winding 168. But in particular when using winding storages with two foils running in parallel, with the number of documents of value possibly present in the recycling storages 86, there can occur a malfunction with the narrow bank notes 160. Because of the offset v the narrow bank notes move further into the center of the winding, so that a lower trouble-proneness even with a great number of stored bank notes can be achieved.

The control device 20' compared to the control device 20 is modified to the effect that it activates devices of the portion for inputting and outputting documents of value by emitting control signals in such a way that the following process is carried out. Here for illustrating Euro bank notes are chosen as bank notes, which are present in denominations of 5 Euro, 10 Euro, 20 Euro, 50 Euro, 100 Euro, 200 Euro and 500 Euro. The five first-mentioned denominations each have different widths and lengths increasing with the denomination, the last three have different lengths increasing with the denomination but equal widths. The recycling storages 86 serve to receive bank notes of the three denominations 5 Euro, 10 Euro and 20 Euro.

A payment can be effected as follows (also cf. FIG. 10*a* to *g*):

A customer feeds an invoice document into the apparatus, from which the control device 20 by means of the invoice reader 12 recognizes the amount to be paid. Then the customer feeds, as already described, means of payment for paying the amount invoiced. Here, only the processing of fed documents of value is to be described in more detail.

When a document of value is fed to the device for accepting documents of value 26', said device takes in the document of value by means of the first transport drive unit 140. It emits a signal to the control device 20', which activates the transport system 28 such that it displaces the temporary storage unit 30' into the accepting position $L_{E2}$, provided that it is not already in this position. This is the accepting position, in which the entrance transport interface 42' faces the second temporary storage transport interface 136, so that a document of value can be stored in the temporary storage 132.

The control device 20' now activates the second transport drive unit 142, if necessary, the diverter 144 and the temporary storage unit 30', in this example the drive unit 138 in it and with that the temporary storage transport interface 136 in such a way that the document of value is transported through the interfaces into the temporary storage 132, in this embodiment the back end of the document of value, when viewed in transport direction, remaining clamped in the temporary storage transport interface 136. This permits an easy transport of the document of value out of the temporary storage 132 at a later point of time (cf. FIG. 10 *a*). In this respect the temporary storage transport interface 136 can be regarded as a part of the temporary storage 132.

In the meantime, the device for accepting documents of value 26 determines by means of own evaluation devices and/or using the control device 20', depending on the embodiment, whether the document of value is a valid voucher or a bank note of an admissible currency according to predetermined checking criteria and recognized as authentic and which value the document of value has. Furthermore, the control device 20' determines, based on the signals of the checking device 40, whether the document of value was taken in too obliquely for a further processing.

For this purpose the control device 20' reads in signals, which reproduce the type, the result of the check as to authenticity or validity and the value, or stores the respective data.

When the control device 20' determines, that the last fed document of value was taken in too obliquely for a further processing and/or not recognized as valid or not as a bank note of a currency acceptable by the apparatus, the device for accepting documents of value 26 is activated such, that for the time being further documents of value are not accepted. Furthermore, the transport system 28 is activated such that it displaces the temporary storage unit 30' into the outputting position $L_{A2}$ (cf. FIG. 10*b*), in which the temporary storage transport interface 136 faces the entrance of the device for outputting documents of value 24, so that the document of value can be outputted from the temporary storage 132 to the device for outputting documents of value 24.

Furthermore, the temporary storage unit 30', to be precise in this example the drive unit 138, is activated such that the temporarily stored document of value is outputted from the temporary storage 132 to the device for outputting documents of value 24, by means of which then a return to the customer is effected. After that, the control device 20' activates the transport system 28 to displace back the temporary storage unit 30' into the accepting position $L_{E2}$.

But when the control device 20' determines, that the last fed document of value was recognized as a valid voucher or as a bank note of a currency acceptable by the apparatus, in the case of a bank note recognized as authentic it compares, whether its recognized value is greater than the greatest denomination of the bank notes to be stored in the storage unit 28', and/or whether the storage unit 28' cannot store bank notes of this denomination any more.

If this is the case, the control device 20' activates the transport system 28 such that it displaces the temporary storage unit 30' into the end storage position LEnd2, in which a document of value stored in the temporary storage 130 can be transported into the end storage device 36 (cf. FIG. 10*c*).

Otherwise, the control device 20' carries out a re-storing of the document of value from the temporary storage 132 into the temporary storage 130 (cf. FIG. 10*d* to 10*e*). For this purpose in this embodiment the control device 20' activates the temporary storage unit 30', in this example the drive unit 138, and the entrance transport interface 42', in this example the second transport drive unit 142 and, if necessary, the diverter 144 or its drive, in such a way that the document of value is outputted from the temporary storage 132 into the holding area 146, the in transport direction back edge of the document of value remaining clamped in the entrance transport interface 42' (cf. FIG. 10*d*). Then control device 20' activates the transport system 28 such that it displaces the temporary storage unit 30' into the accepting position $L_{E1}$, in which a document of value can be transported through the entrance transport interface 42' into the temporary storage 130.

Having reached this position the control device 20' activates the second transport drive unit 142 and the temporary storage unit 30', in this example the drive unit 138, such that the held document of value is transported from the holding area 146 into the temporary storage 130 (cf. FIG. 10*e*).

Then control device 20' stores data about the value of the document of value, the type of the document of value, information about the recognized authenticity of the document of value and the position of the document of value in the temporary storage unit 30', in the example the temporary storage 130.

After that the control device 20' initiates a further taking in of a further document of value, which is treated like the preceding one.

During the feed of means of payment the control device 20', based on signals of the device for accepting documents of value 26 and the other portions, permanently determines the total amount of the deposited means of payment and compares it to the amount to be paid. When the total amount exceeds the amount to be paid, it activates the payment apparatus such that it shows to the person depositing an appropriate notice, for example by means of a display device not shown in the Figures, and does not accept any further means of payment.

Then the control device 20' carries out a storing step, in which the accepted temporarily stored documents of value are stored in the storage unit and/or the end storage. For this purpose the control device 20', in dependence on the position and the type of the documents of value temporarily stored in the temporary storage unit 30' and on the fill level of the storage unit 32, activates the transport system 28 such that it successively moves to an appropriate storing position according to the type, in case of bank notes in particular to the denomination, of the document of value to be outputted next from the temporary storage unit 30' to the storage unit 32' or the end storage 36 and passes on into this storing position the next document of value to the storage unit 32' or, when the storage unit 32' is filled with bank notes of the denomination of the bank note to be passed on, to the end storage 36. The storage unit 32' or the end storage 36 is activated to receive the document of value and to store it. The storing step is completed, when the accepted documents of value stored in the temporary storage unit 30', to be precise the temporary storage 130, are stored in the storage unit 32' or the end storage 36.

Before that, at the same time or after that the control device 20' determines in dependence on the number and denomination of the bank notes stored in the storage unit 32', of the amount invoiced and the other fed means of payment, which bank notes are to be returned as change or part of the change.

In an outputting step the control device 20' then activates, beginning with the denomination that is stored in the most bottom part of the storage unit 32', the transport system 28, the storage unit 32' and the temporary storage unit 30' such that the temporary storage unit 30' successively displaces into storing positions corresponding to the denominations to be outputted at that time and that in these positions appropriate bank notes from the storage unit 32' are stored into the temporary storage unit 30', to be precise the temporary storage 130.

After the storage of the last bank note of the change to be outputted in the temporary storage unit 30', the control device 20' activates the transport system 28 such that it displaces the temporary storage unit 30' into the outputting position $L_{A1}$, in which documents of value can be outputted from the temporary storage 130 to the device for outputting documents of value 26. In the example in this case the first temporary storage transport interface 134 and the output transport interface 108 are facing each other.

After that it activates the temporary storage unit 30', to be precise the drive unit of the temporary storage 130 and the drive unit 138 (cf. FIG. 10*g*), to pass on the temporarily stored documents of value to the device for outputting documents of value 24. Following respective signals of the control device 20', then the output of the bank notes as change or part of the change is effected. With that the outputting step is completed.

Finally, the transport system 28, following corresponding signals of the control device 20', displaces the temporary storage unit 30' into the accepting position $L_{E2}$.

In another variant of this embodiment, the output of the change is effected analogously to the above described second example for the process before the storage of the accepted documents of value in the storage unit 32' or the end storage 36. The process steps until the recognition of the end of the deposit are the same as in the variant described immediately hereinbefore. The last of these steps is that when the total amount exceeds the amount to be paid, the control device 20' activates the payment apparatus such that it shows to the person depositing an appropriate notice, for example by means of a display device not shown in the Figures, and does not accept any further means of payment.

After that the control device 20' determines in dependence on the number and denomination of the bank notes stored in the storage unit 32', on the amount invoiced and the other fed means of payment, which bank notes are to be returned as change or part of the change.

Beginning with the denomination, which is stored in the most bottom part of the storage unit 32', it activates the transport system 28, the storage unit 32' and the temporary storage unit 30' such that the temporary storage unit 30' successively displaces into storing positions corresponding to the denominations to be outputted at that time and that in these positions appropriate bank notes are stored from the storage unit 32' into the temporary storage unit 30', to be precise the temporary storage 130 (cf. FIG. 10*g*).

After the storage of the last bank note of the change to be outputted in the temporary storage unit 30', the control device 20' activates the transport system 28 such that it displaces the temporary storage unit 30' into the outputting position $L_{A1}$, in which documents of value can be outputted from the temporary storage 130 to the device for outputting documents of value 26. In the example in this case the first temporary storage transport interface 134 and the output transport interface 108 are facing each other.

After that it activates the temporary storage unit 30', to be precise the drive unit of the temporary storage 130 and the drive unit 138 (cf. FIG. 10*g*), to pass on the temporarily stored documents of value to the device for outputting documents of value 24. Following respective signals of the control device 20', then the output of the bank notes as change or part of the change is effected. Now in the temporary storage unit 30', to be precise the temporary storage 130, are present only the documents of value deposited and intended for being stored in the storage unit 32' and the end storage 36.

For storing these documents of value the control device 20', in dependence on the position and the type of the documents of value temporarily stored in the temporary storage unit 30', in the example to be precise the temporary storage 130, and on the fill level of the storage unit 32, activates the transport system 28 such that it successively moves to an appropriate storing position according to the type, in case of bank notes in particular to the denomination, of the document of value to be outputted next from the temporary storage unit 30' to the storage unit 32' or the end storage 36 and passes on into this storing position the next document of value to the storage unit 32' or, when the storage unit 32' is filled with bank notes of the denomination of the bank note to be passed on, to the end storage 36. The storage unit 32' or the end storage 36 is activated to receive the document of value and to store it.

Finally, the transport system 28, following corresponding signals of the control device 20', displaces the temporary storage unit 30' into the accepting position $L_{E2}$.

An especially favorable formation of the interfaces of the apparatus, which also represents an example for an apparatus for handling documents of value, is illustrated in FIG. 12 to 15 with reference to one of the recycling storages 86 of the storage unit 32 as a first device as an example, which has a transport path portion 148, along which a document of value is transported from the first device, and the temporary storages 130 and 132 as second devices, which have a transport path portion 150, along which a document of value is transported to and/or from the second devices. For simplicity's sake in FIG. 12 to 14 as a second device only the temporary storage 130 is shown, but the explanations apply to the temporary storage 132 accordingly. Instead of by the recycling storage 86 the first device could also be given by the entrance transport device 44', the transport path portion the transport path portion $T_{A'}$ and the pair of rolls representing the entrance transport interface 42'.

The transport system 28 represents a moving device, by means of which the second transport path portions 150 are movable along a predetermined curve, here the substantially vertically extending motion path of the temporary storage unit 30' given by the guide rails 70 relative to the storage unit 32' or the storage 86 and with that the first transport path portion 148, so that in at least one coupling position of the devices to each other, namely in the case that the temporary storage unit assumes one of the accepting positions, a document of value can be transported from the transport path portion 148 of the first device into the transport path portion of the second device corresponding to the accepting position.

At one coupling end K of each of the transport paths in a fixed position in relation to the corresponding transport path portion are located the entrance transport or temporary storage transport interfaces 44' or 134 and 136, which each have at least one pair of rolls 156 or 158 mounted rotatably around rotation axes 152 or 154. Between the rolls 160 or 160' of each pair of rolls 156 or 158 a document of value is guided and clamped during the transport.

Since the motion curve for the temporary storage unit is linear, the curve portion extends in a plane, which is given by the curve portion and the transport direction R in the transport path portions. The rotation axes 152 and 154 therefore are aligned in parallel to each other.

As illustrated in FIG. 12 to 14 and in particular FIG. 15, the rolls 160, in this example all formed equally for all interfaces that are not part of the temporary storage unit 30', in a section through the rotation axis have a comblike structure. Here the protruding areas 162 of the circumference of the rolls of a pair form the portions guiding or clamping the document of value and do not mesh into the recessed, groovelike areas 164 of the rolls, so that the document of value is not deformed (cf. FIGS. 12 and 13).

Now the pairs of rolls 156 and 158 are disposed and formed such that on the one hand in the respective accepting position the corresponding rolls 160 and 160' of the pairs of rolls 156 and 158 intermesh in a combing fashion (cf. FIGS. 12 and 14) and on the other hand when the temporary storage unit 30' and with that the pairs of rolls 158 are moved into or from the accepting position said rolls are guided past each other in a combing fashion (cf. FIG. 12 and FIG. 14). For this purpose the equally formed rolls of the pairs of rolls 158 likewise have a comblike profile, which, however, can differ from that of the other rolls, so that a meshing can be achieved (cf. FIG. 14). Here too, the protruding areas of the rolls face each other.

By the combing mesh in the accepting position, when viewed in parallel to the transport direction, a gapless coupling of the transport path portions can be achieved, which allows an operation with a very low trouble rate.

On the other hand, a transport of the temporary storage unit 30' is still possible.

The entrance transport interface 44', the other storage transport interfaces 90 and the output transport interface 108, except for the drive, are formed like the storage transport interface 90, and in the motion direction of the temporary storage unit 33' and thus the second transport path portions 150 they are aligned to each other such that the recessed areas are flush in this direction, so that the pairs of rolls 158 on a displacement of the temporary storage unit 30' are guided in a combing fashion by the pairs of rolls of the entrance transport interfaces, storage transport interfaces and output transport interfaces.

The interfaces differ from each other in the type of their drive.

In the storage transport interfaces, entrance transport interfaces and output transport interfaces only one roll is driven. Here for the storage transport interfaces one joint drive unit is provided, which is connected with the driven rolls via a belt.

Both the entrance transport interface and the output transport interface are provided with a separate drive unit, in the case of the entrance transport device a stepper motor.

Though the temporary storage transport interfaces 134 and 136 have a joint drive unit, in the temporary storage transport interface 136 the two rolls are mechanically driven coupled by toothed wheels, while in the temporary storage transport interface 134 only the upper roll is driven.

As recognizable in the Figures in the coupling position lines given by a gap that is formed between the rolls of a respective pair of rolls or by a tangent line along which the rolls of a respective pair of rolls touch each other lie in a plane with the coupling end of the transport path portions.

As illustrated in FIG. 14, the rolls of the two pairs of rolls intermesh to such an extent, that in case of a combing mesh protruding areas of the rolls of the one pair of rolls are located in a plane extending through the rotation axes of the rolls in a distance of between 0.5 millimeters and 3 millimeters from the axis or the recessed area of the rolls of the second pair of rolls. In the example this distance d amounts to about 1 millimeter.

In this embodiment each of the rolls comprises a plurality of equally formed wheels 161', which are held on a pivotally supported shaft 161 or axle in equal distance from each other. The wheels form the protruding areas.

The outside diameter of the rolls is chosen between 13 millimeters and 25 millimeters and in this example amounts to 16 millimeters.

At least the protruding surface areas of the rolls, in particular of the driven rolls are made of an elastic material, in the example of an elastic polymer material, which slightly deforms during the passage of a document of value through the pair of rolls.

This formation of the transport interfaces or transport interface devices is advantageous for all transport interfaces or transport interface devices of the apparatuses of the embodiments, i.e. in particular the accepting interface, temporary storage interface, storage interface and output transport interface.

Variations of the above described embodiments differ from each other by the formation of the storage unit 32 or 32' and the formation, in the example the programming of the control device 20 or 20'. All other properties are unchanged, so that the reference signs and the explanations also apply accordingly here.

In these variations, of which in FIG. 11 is shown a variant of the apparatus of FIGS. 1 and 2 as an example, the storage unit 32" differs from those of the above embodiments in that it is provided with a further retainer 170 for an output storage for outputting singled bank notes, which a stacking cassette 172 for a, compared to the capacity of the recycling storages 86, greater storage capacity and a singler 174 for singling the documents of value from the stacking cassette. This stacking cassette can serve as a pure output storage for bank notes of one of the denominations, which are also stored in the recycling storages 86. In particular it can store bank notes of especially frequently paid out denominations or bank notes of the smallest denomination. Before a corresponding transport path portion leading from the output storage again a storage transport interface 176 is disposed.

Now the control device, compared to the control devices of the above embodiments, is changed to the effect that when determining the type and the number of bank notes to be outputted it takes into account the number and denomination of the bank notes stored in the output storage, and activates the transport system such that it determines, whether on the removal of the determined number of bank notes of the smallest denomination from the appropriate storage 86 the fill level falls below a minimum fill level of this storage. In the outputting step it activates the storage unit and the temporary storage unit such that in the corresponding storing position they remove only so many bank notes from the storage 86 that the fill level does not fall below a minimum. Furthermore, it activates the transport system to displace the temporary storage unit into an appropriate coupling position in front of the storage transport interface for the output storage. Then it activates the output storage, the respective storage interface and temporary storage transport interface and the temporary storage unit such that the still required number of bank notes to be outputted are stored from the payout storage into the temporary storage unit. The following partial steps of the outputting step remain unchanged.

Further embodiments differ from the embodiments described above in that instead of the three recycling storages at least four, preferably five recycling storages are provided, which in particular can be equally formed, but which is not necessary. With that it is permitted that the denominations 5 Euro, 10 Euro, 20 Euro, 50 Euro and 100 Euro are re-outputted in the case of a formation suitable for the payment with Euro.

Other embodiments differ from the embodiments described above in that at least one of the recycling storages is a stacking storage with a singler. Here the singler can be part of the stacking storage or part of the storage unit. Said storages permit the storing of an especially great number of documents of value or bank notes. Here it is possible, that for example only the recycling storage for the smallest denomination is formed as a stacking storage, because for this denomination the greatest output requirement is expected.

Further embodiments differ from the embodiments and variations described above in that between the input pocket and the checking device an aligning path for the alignment of inputted documents of value is provided. The alignment here can be a middle centering of the bank notes or a side alignment, depending on the formation of the checking device.

In other variations of the embodiments the input pocket is formed as an input pocket for a bank note stack, to which a singler for singling an inserted bank note stack is disposed downstream.

Further variations of the above mentioned embodiments can be, that the device for outputting documents of value is formed as an output device for outputting documents of value as a clamped bundle or loose bundle.

Further embodiments differ from the embodiments described above in that the end storage 36 is not a free-fall cassette, but a stamp-in cassette or a safebag and the apparatus accordingly has a modified retainer for this type of end storage.

Still further embodiments differ from the embodiments described above solely in that vouchers are not processed, and that, accordingly, the checking device does not have a respective device and the programming of the control device is changed accordingly.

In other embodiments the device for outputting documents of value 24 can also be disposed below the checking device.

Still further embodiments differ from the embodiments described above only in that the control device is modified. The modification consists in that the control device, when it has determined the end of a deposit or received a termination signal, which the customer has triggered via an input unit of the apparatus, does not carry out a payout and storing step, but activates the transport system to displace the temporary storage unit from the accepting position into the outputting position. When the temporary storage unit is in this position, it activates the temporary storage unit and the device for outputting documents of value such that the accepted documents of value temporarily stored in the temporary storage unit are re-outputted.

Further embodiments differ from the embodiments described above only in that the card reader and/or the device for the deposit and payout of coins and the functionality of the control device necessary for its or their use are not provided.

A further embodiment is the result, when the first and second devices are not disposed in a fashion movable relative to each other, but in a fixed relative position to each other.

In FIG. 17 is schematically shown an apparatus for handling documents of value for covering longer portions. There is provided a further pair of rolls mounted to be rotatable around a rotation axis, between the rolls of which a document of value is clamped when transported and the rolls of which in a section through the rotation axis have a comblike structure, and which combs with the pair of rolls for the first or second device. The additional pair of rolls here is formed like the second pair of rolls 158.

The invention claimed is:

1. An apparatus for handling documents of value comprising:

at least a first device, which has a first transport path portion, along which a document of value is transported to and/or from the first device and/or into the first device, the first transport path portion having a first coupling end;

at least a second device, which has a second transport path portion, along which a document of value is transported to and/or from the second device and/or into the second device, the second transport path portion having a second coupling end;

a moving device, by means of which the second transport path portion is movable relative to the first transport path portion along a predetermined curve, so that in at least one relative coupling position of the first and second devices a document of value is transportable from the transport path portion of the first device into the one of the second device and/or from the transport path portion of the second device into the one of the first device;

at the first coupling end of the transport path portion, a first pair of rolls in a fixed position in relation to the first transport portion is mounted to be rotatable around a first rotation axis, between the rolls of which a document of value is moved, wherein each roll of the pair of rolls of which in a section through the rotation axis has a comblike structure; and at the second coupling end a second pair of rolls in a fixed position in relation to the second transport path portion is mounted to be rotatable around a second rotation axis, between the rolls of which a document of value is moved, wherein each roll of the second pair of rolls of which in a section through the rotation axis has a comblike structure, wherein the first and second pair of rolls are arranged and formed such that in the coupling position the rolls of the first pair of rolls mesh with the rolls of the second pair of rolls and in case of a move into or from the coupling position the rolls of the first pair of rolls move past the rolls of the second pair of rolls in a meshing fashion.

2. The apparatus according to claim 1, wherein the curve portion extends in a plane.

3. The apparatus according to claim 1, which has at least one further device, which has a transport path portion, along which a document of value is transported to the and/or from the further device and/or into the further device, and which is disposed in a fixed position relative to the first device along the curve portion, so that in at least one relative coupling position of the devices a document of value is transportable from the transport path portion of the further device into the one of the second device and/or from the transport path portion of the second device into the one of the further device, wherein at a coupling end of the transport path of the further device, a third pair of rolls is disposed in a fixed position in relation to the transport path portion and mounted to be rotatable around a rotation axis, between the rolls of which a document of value is moved, wherein each roll of the pair of rolls has a comblike structure, and the third pair of rolls being disposed and formed at the end of the transport path portions of the further device and the second device such that the rolls of the third pair of rolls at the end of the transport path portion of the further device mesh with the rolls of the second pair of rolls of the second device in the coupling position and in case of a movement into the or from the coupling position are moved past each other in a meshing fashion.

4. The apparatus according to claim 3, wherein the rolls of the pairs of rolls for the first and the further device are equally formed.

5. The apparatus according to claim 3, including a joint drive unit, which drives at least one of the roll of the pairs of rolls at the coupling end of the transport path portions of the first and the further device.

6. The apparatus according to claim 1, wherein in the coupling position a gap is formed between the first and second pair of rolls or by a tangent line along which the rolls of a respective pair of rolls touch each other lie in a plane with the coupling end of at least one of the transport path portions.

7. The apparatus according to claim 1, including a drive unit for at least one roll of one of the pairs of rolls for rotating the roll.

8. The apparatus according to claim 7, wherein the drive unit comprises a stepper motor.

9. The apparatus according to claim 1, wherein the rotational movements of the rolls of at least one of the pairs of rolls are coupled.

10. The apparatus according to claim 1, wherein there is provided a drive unit for the first and second pair of rolls arranged to at least one of the rolls of the respective pairs of rolls.

11. The apparatus according to claim 1, wherein the rolls of the first and second pair of rolls intermesh to such an extent, that in case of a combing mesh protruding areas of the rolls of the one pair of rolls are located in a plane extending through the rotation axes of the rolls in a distance of between 0.5 millimeters and 3 millimeters from the axis or the recessed area of the rolls of the second pair of rolls.

12. The apparatus according to claim 11, wherein the outside diameter of the rolls amounts to between 13 millimeters and 25 millimeters.

13. The apparatus according to claim 1, wherein rolls of at least one of the pairs of rolls have the same outside diameter.

14. The apparatus according to claim 13, wherein the rolls of the pairs of rolls for the first and the second transport path portion have the same outside diameter.

15. The apparatus according to claim 1, wherein at least the protruding surface areas of at least the driven rolls are made of an elastic material.

16. The apparatus according to claim 1, which is arranged to accept, check documents of value as well as to output documents of value, and further comprises: a checking device for checking the authenticity of fed documents of value, a storage unit, which as first and further devices comprises at least two storages arranged to store at least two different types of documents of value, so that a document of value of each of the two types, independently of the order of input of the documents of value into the storage unit, can selectively be outputted from the storage unit and the pairs of rolls each form storage transport interfaces, as a second device a temporary storage of a temporary storage unit for the singled temporary storage of at least two checked documents of value, which is displaceable between at least one accepting position, in which storage of documents of value transported from the checking device in the temporary storage unit is enabled, and storing positions associated to the storages and representing coupling positions, in which at least some of the documents of value temporarily stored in the temporary storage unit are transportable from the temporary storage unit into the respective storage, the first and second pair of rolls being part of a temporary storage transport interface, and said moving device comprising a transport system, by means of which the temporary storage unit is displaceable between the accepting position and the storing positions.

17. The apparatus according to claim 16, wherein at least one of the storages is a storage from which documents of value can be outputted in singled fashion.

18. The apparatus according to claim 17, wherein the one storage comprises a winding storage.

19. The apparatus according to claim 16, wherein at least one of the storages is a storage in which at least two documents of value are storable in singled form.

20. The apparatus according to claim 16, wherein the storage unit has at least one output storage from which only documents of value are outputted.

21. The apparatus according to claim 16, wherein the at least two storages are disposed such that the at least one accepting position and the storing positions are located along a linear path.

22. The apparatus according to claim 16, wherein the linear path extends in a substantially vertical fashion.

23. The apparatus according to claim 16, wherein a retaining device with at least one retainer is provided for at least one of the two storages, and the at least one storage is configured as a module connectable with the respective retainer and detachable from it.

24. The apparatus according to claim 16, wherein the retainer and the at least one storage are arranged such that the at least one storage is connectable with and detachable from the respective retainer without tools.

25. The apparatus according to claim 16, wherein the temporary storage unit is provided with a temporary storage for at least two documents of value, said temporary storage arranged such that said at least two documents can be inputted into the temporary storage or outputted from it only one after the other.

26. The apparatus according to claim 16, wherein the temporary storage unit is provided with at least two temporary storages.

27. The apparatus according to claim 26, wherein at least one of the at least two temporary storages is a temporary storage for a single document of value.

28. The apparatus according to claim 26, wherein at least one of the at least two temporary storages is a temporary storage, said temporary storage arranged such that said at least two documents for at least two documents of value, can be inputted into the temporary storage or outputted from it only one after the other.

29. The apparatus according to claim 26, wherein each of the at least two temporary storages is a temporary storage for a single document of value, said temporary storage arranged such that said single document can be fed or outputted therein or therefrom.

30. The apparatus according to claim 16, wherein the temporary storage unit has a temporary storage transport interface for each of the temporary storages, by means of which a document of value is feedable to the temporary storage or to the respective temporary storages and/or can be taken from the temporary storage or the respective temporary storages.

31. The apparatus according to claim 30, wherein for the temporary storage transport interfaces a joint drive is provided.

32. The apparatus according to claim 16, wherein the transport system together with the temporary storage unit forms an electric linear motor.

33. The apparatus according to claim 16, wherein the transport system comprises a drive unit arranged fixed relative to a base element of the apparatus.

34. The apparatus according to claim 33, wherein the transport system comprises a belt connected with the temporary storage unit and/or a chain connected with the temporary storage unit, which is driven by the drive unit of the transport system.

35. The apparatus according to claim 16, wherein the transport system has a spindle as well as a drive unit for rotating the spindle and the temporary storage unit has an element interactive with the spindle, so that the drive displaces the temporary storage unit by rotating the spindle.

36. The apparatus according to claim 16, wherein the transport system comprises a drive unit connected with the temporary storage unit.

37. The apparatus according to claim 36, wherein the transport system has a rack firmly connected with the storage unit and the temporary storage unit has a pinion engaging into the rack, the rack being driven by the drive unit.

38. The apparatus according to claim 16, including an entrance transport device, by means of which single documents of value can be transported from an input pocket through the checking device.

39. The apparatus according to claim 38, wherein the entrance transport device has an entrance transport interface device, by means of which documents of value transported from the checking device are transportable into the temporary storage unit with the temporary storage unit in the at least one accepting position.

40. The apparatus according to claim 38, wherein the entrance transport device and/or the entrance transport interface device as well as the checking device are arranged for the bi-directional transport.

41. The apparatus according to claim 16, including a further storage with a storing position associated thereto, into which documents of value from the temporary storage unit can be stored in the respective storing position, but out of which the documents of value are not passed on to the temporary storage unit.

42. The apparatus according to claim 41, wherein the further storage is disposed in the storage unit.

43. The apparatus according to claim 16, including an output storage and/or a retainer for an output storage, from which documents of value are transportable in a singled fashion into the temporary storage unit.

44. The apparatus according to claim 43, wherein the output storage comprises a stacking storage, the stacking storage or the retainer having a singler.

45. The apparatus according to claim 1, wherein at least one of the storages comprises a storage in which documents of value are storable as a stack.

46. The apparatus according to claim 45, wherein for the storage a singler is provided.

* * * * *